United States Patent [19]

Loss et al.

[11] 3,956,243

[45] May 11, 1976

[54] PROCESS FOR FLAMEPROOFING ORGANIC FIBRE MATERIAL

[75] Inventors: Rudolf Loss, Liestal; René Berini, Birsfelden; Armin Hiestand, Binningen; Peter Hofmann, Basel; Hermann Nachbur, Dornach, all of Switzerland

[73] Assignee: Ciba-Geigy Corporation, Ardsley, N.Y.

[22] Filed: Dec. 7, 1973

[21] Appl. No.: 422,819

[30] Foreign Application Priority Data

Dec. 15, 1972 Switzerland ..... 18308/72

[52] U.S. Cl. ..... 260/67.6 R; 8/115.7; 8/116 P; 8/183; 252/8.1; 252/8.8; 260/67.6 C; 260/70 R; 260/72 R; 260/849; 260/DIG. 24; 428/480; 428/527; 428/921

[51] Int. Cl.[2] ..... D06M 13/44; C09K 3/28

[58] Field of Search ..... 260/849, 67.6 R, 70 R, 260/DIG. 24; 117/136, 137, 139.5 A; 252/8.1, 8.8; 8/115.7

[56] References Cited

UNITED STATES PATENTS

| | | | |
|---|---|---|---|
| 3,224,991 | 12/1965 | Wilfert | 260/849 |
| 3,310,419 | 3/1967 | Wagner | 117/137 |
| 3,509,049 | 4/1970 | Zweidler | 252/8.8 |
| 3,632,396 | 1/1972 | Perez-Zamora | 117/139.5 A |
| 3,756,950 | 9/1973 | Gluck | 252/8.8 |

FOREIGN PATENTS OR APPLICATIONS

| | | |
|---|---|---|
| 1,324,628 | 7/1973 | United Kingdom |
| 526,673 | 9/1972 | Switzerland |

*Primary Examiner*—John C. Bleutge
*Attorney, Agent, or Firm*—Joseph G. Kolodny; Edward McC. Roberts; Prabodh I. Almaula

[57] ABSTRACT

Composition for flameproofing organic fibre material which contains at least 1. a tetrakis-(hydroxymethyl)-phosphonium compound, its self-condensation product or its condensation product with a reactive nitrogen compound
2. an aliphatic amide or an imidazole or an imidazoline as agent for imparting a soft handle
3. a methylolated amino groups containing 1,3,5-triazine and, optionally,
4. an optionally methylolated and esterified derivative of a urea and, optionally,
5. a low molecular amine.

These compositions yield flameproof finishes paired with a soft handle especially on polyester-cotton blends.

25 Claims, No Drawings

PROCESS FOR FLAMEPROOFING ORGANIC FIBRE MATERIAL

The invention relates to a process for flame-proofing organic fibre material, preferably containing polyesters, characterised in that this material is treated with a preparation which contains at least 1. a tetrakis-(hydroxymethyl)-phosphonium compound, its self-condensation product or its condensation product with a reactive nitrogen compound, 2. an agent for imparting a soft handle, of the formula

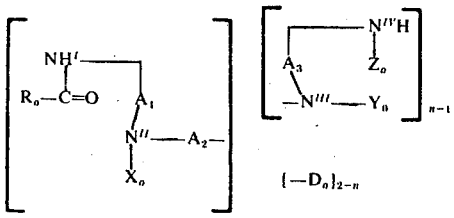

wherein $X_o$ and $Y_o$ each denote hydrogen, alkyl with 1 to 4 carbon atoms or $—CONH_2$, $Z_o$ denotes hydrogen, alkyl with 1 to 4 carbon atoms, $—CONH_2$, $—C^{II}OR_o'$ or $—A_4—NHCO—R_o''$, $A_1$, $A_2$, $A_3$ and $A_4$ each denote alkylene with 2 or 3 carbon atoms, $D_o$ denotes hydrogen, —OH, $—NH_2$,

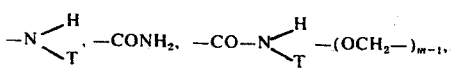

$R_o$, $R_o'$, $R_o''$ and $R_o'''$ each denote alkenyl or alkyl with 9 to 23 carbon atoms, T denotes hydrogen or $—CO—NH_2$ and m and n each denote 1 or 2 and $X_o$ can also be a covalent bond to $C^I$ if H on $N^I$ and O on $C^I$ are omitted and there is a double bond between $N^I$ and $C^I$, and $Y_o$ can also be a covalent bond to $C^{II}$ if n=2, Z denotes $—CO^{II}—OR_o'$, H on $N^{IV}$ and O on $C^{II}$ are omitted and there is a double bond between $N^{IV}$ and $C^{II}$, these softeners optionally being quaternised by alkyl halides or dialkyl sulphates which possess 1 or 2 carbon atoms per alkyl radical or halogenocarboxylic acid alkyl esters which contain up to 4 carbon atoms in the acid part and up to 22 carbon atoms in the alcohol part or up to 60 carbon atoms if the alkyl chains are interrupted by oxygen atoms, or being, where appropriate, in the form of acid salts of alkylcarboxylic acids with at most 4 carbon atoms, 3. a water-soluble 1,3,5-triazine which possesses 2 to 4 methylolated amino groups, 4. optionally, an optionally methylolated and optionally etherified compound of the formula (2) 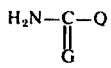

wherein G denotes oxygen or NH and Q denotes $—NH_2$, —NH—C ≡ N or $—NHCONH_2$, or wherein G and Q together represent ≡ N and 5. optionally, a low molecular amine, and that the material treated in this way is subjected to a fixing process.

Component (1) is thus a monomeric tetrakis-(hydroxymethyl)-phosphonium compound, a self-condensation product of such a phosphonium compound or a condensation product of such a phosphonium compound with a reactive nitrogen compound.

Possible tetrakis-(hydroxymethyl)-phosphonium compounds are above all the corresponding hydroxides or especially the salts. Amongst the salts, the halides such as, for example, the bromide or especially the chloride, are preferred. Tetrakis-(hydroxymethyl)-phosphonium chloride is hereafter referred to as THPC.

The self-condensation products are prepared by condensing at least one anhydrous tetrakis-(hydroxymethyl)-phosphonium salt or hydroxide with itself in an anhydrous medium, optionally using an acid catalyst, optionally in the presence of at least one inert organic solvent, and optionally under reduced pressure, at 100° to 150°C, preferably 100° to 145°C, and especially 125° to 145°C, the condensation being continued until 0.5 to 1.5 mols of water have been separated off per mol of phosphonium compound employed, free hydroxyl groups being optionally etherified, at least partially, with at least one alkanol with 1 to 4 carbon atoms, and the salts of the self-condensation products optionally being converted into the correspondng hydroxides.

The self-condensation is preferably carried out at the reflux temperature of the solvent or solvent mixture used. Suitable solvents are above all aromatic hydrocarbons such as, for example, toluene, o—, m— or p—xylene or a mixture thereof, or xylene, toluene, xylene-benzene or xylene-decahydronaphthalene mixtures. Halogenated aliphatic hydrocarbons, especially 1,2,3-trichloropropane, are also suitable. The self-condensation is preferably carried out in vacuo at 125° to 145°C and especially at 135° to 145°C.

At the same time it is however also possible to carry out the condensation in the absence of an inert organic solvent, for example by using previously prepared self-condensation product as the solvent or carrying out the condensation in the melt.

An appropriate procedure is first completely to free the tetrakis-(hydroxymethyl)-phosphonium compound, which as a rule is in the form of an aqueous solution, from the water of the solution by distillation and then to initiate the self-condensation. This process can be carried out continuously or stepwise.

The self-condensation is preferably continued until about 0.7 to 1.2 mols, or especially 0.8 to 1.2 mols, of water of condensation have been separated off per 1 mol of phosphonium compound employed.

Amongst the tetrakis-(hydroxymethyl)-phosphonium salts used, the halides such as, for example, the bromide or especially the chloride, are in turn preferred.

Where tetrakis-(hydroxymethyl)-phosphonium hydroxide (THPOH) is used as the starting product, it is appropriately first prepared from a corresponding salt, for example THPC, by neutralisation, preferably at a pH value of 7 to 7.5 in aqueous solution by means of a base, for example sodium hydroxide, and subsequent dehydration.

The optionally required etherification of the self-condensation product which still contains free hydroxyl groups is effected with, for example, n-butanol, n-propanol, ethanol or especially methanol. This is preferably carried out in an acid medium.

The acid catalysts which are optionally used in the self-condensation are preferably potentially acid salts (LEWIS acids) such as magnesium chloride, iron-III chloride, zinc nitrate or boron trifluoride/diethyl ether. The use of these catalysts is particularly advisable in the case of the self-condensation of THPOH and when carrying out the condensation at below 120°C.

After completion of the self-condensation and of the etherification, if relevant, the salts of the self-condensation product can also be wholly or partially converted into their corresponding hydroxides, which as a rule is achieved by adding strong bases such as alkali metal hydroxides or alkaline earth metal hydroxides, for example, sodium hydroxide, potassium hydroxide or calcium hydroxide, and also sodium carbonate. The amount of base is appropriately so chosen that the pH value of the reaction mixture is about 5 to 8. The conversion is appropriately effected in the application bath.

Such self-condensation products are known, for example, from Belgian Pat. Specification No. 770,256.

These self-condensation products can optionally be condensed further with an amide and/or amine at 10° to 100°C.

The further reaction is as a rule carried out in a water-soluble solvent such as ethanol or above all methanol or preferably in water itself. At the same time it is also possible to carry out the condensation in the melt of the two components.

As a rule, the procedure followed is that the reaction mixture is warmed with rapid stirring, whereby a clear solution is in most cases produced, and is then warmed further until gelling occurs. The gelled product can then be dried and powdered. The end products are, as a rule, water-insoluble, but depending on the starting components and reaction conditions water-soluble products can also be obtained.

Both aliphatic and aromatic or heterocyclic amines and/or amides can be used as the amines or amides.

The amines preferably contain at least one primary or secondary amino group. Preferably, the amines contain at most 18 carbon atoms. Examples of such amines are dodecylamine, ethylenediamine, dimethylaminopropylamine, stearylamine, allylamine, diglycolamine, monoethanolamine, diethylenetriamine, tetraethylenepentamine, 1,3-propanediamine, N-aminoethylenethanolamine, aminopropyldiethanolamine, polyoxypropylenediamines (for example molecular weight 150 to 2,000), aniline, 2,4,6-tribromoaniline, aminopropylmorpholine and bis-(aminopropyl)-piperazine. Examples of further amines are: Piperidine, nonylcyclohexylamine, phenyldiethanolamine, N-methyl-ethanolamine, methylaminopropylamine, methylimino-bispropylamine, methoxypropylamine, imino-bis-propylamine, cyclohexylamine, 2-aminopyrimidine, cyclohexylpropylenediamine, dimethylaniline, 4,4'-diaminodiphenylmethane, dihydroxyethylaniline and monohydroxyethylaniline.

The amides are preferably amides of carboxylic acids with, preferably, at most 18, and in particular at most 4, carbon atoms. The nitrogen atom of at least one amide group is as a rule not substituted further, unless a cyclic amide is concerned. Examples of such amides are urea, guanidine, cyanamide, melamine, acrylamide, dicyandiamide, ethyleneurea and guanidine salts such as the carbonate, nitrate, sulphate, phosphate or acetate. Further amides are: Biuret, acetylenediurea, thiourea, guanylurea (or its salts), triazines, (alkyl-substituted), propyleneurea, hydroxypropyleneurea, glyoxalurea, urones and carboxylic acid diamides (up to at most 6 carbon atoms).

Amides which contain a nitrogen atom which can be methylolated can also be employed in the form of their methoylol compounds.

Preferably 1 to 15 parts by weight and preferentially 1.5 to 10 parts by weight, of the self-condensation product are employed per one part of amine or amide.

The reactive nitrogen compounds which form a condensation product with the tetrakis-(hydroxymethyl)-phosphonium compound are the most diverse polyfunctional nitrogen compounds which, if they contain a nitrogen atom which can be methylolated, can also optionally be in the methylolated form. Preferred nitrogen compounds are so-called aminoplast precursors or aminoplast precondensates.

Aminoplast precursors are as a rule nitrogen compounds which can be methylolated and aminoplast precondensates are addition products of formaldehyde to nitrogen compounds which can be methylolated.

The following may be mentioned as aminoplast precursors or as nitrogen compounds which can be methylolated: 1,3,5-Aminotriazines such as melamine or N-substituted melamines, for example N-butylmelamine, N-trihalogenomethylmelamines, triazone as well as ammeline, guanamines, for example benzoguanamines, acetoguanamines or diguanamines, alkylureas or arylureas or alkylthioureas or arylthioureas, alkyleneureas or alkylenediureas, urones, triazones, cyanamide, dicyandiamide, urea and thiourea themselves, guanidine, guanylurea, biuret, aliphatic amides or carbamates.

Further, it is also possible to use amines, especially primary aliphatic amines, isocyanurates and cyclic dienes containing nitrogen.

Of course, reactive nitrogen compounds capable of salt formation can also be employed in the form of their salts, for example halides such as chlorides or bromides, nitrates, sulphates or phosphates or organic salts such as formates, acetates or propionates.

Preferred reactive nitrogen compounds are selected from the series of the optionally methylolated and optionally etherified nitrogen compounds consisting of cyanamide, dicyandiamide, urea, thiourea, biuret, guanidine, guanidine salt, guanylurea, guanylurea salt, monocyclic or bicyclic urea, carboxylic acid amide, carboxylic acid carbamate or amino-1,3,5-triazine or from the series of amines, penta-azo-bicyclo-nonadienes or their salts or trisglycidylisocyanurate.

The following nitrogen compounds may be mentioned as specific examples: Cyanamide, dicyandiamide, monomethyloldicyandiamide, urea, monomethylolurea, dimethylolurea, guanidine, guanylurea, guanylurea phosphate, ethyleneurea, propyleneurea, acetylenediurea, N,N'-dimethylol-glyoxalurea, N,N'-dimethylol-4-methoxy-5,5-dimethylhexahydropyrimidone-2, N,N'-dimethylol-N''-ethyltriazone, dimethylolethyleneurea, dimethylolpropyleneurea, thiourea, monomethylolurea, and dimethylolurea, biuret, monomethylolbiuret or dimethylolbiuret, acetoguanamine, benzoguanamine, acetoguanamide, ammeline, ammelide, melamine, 1-diethylphosphonoethyl-3,5-diaminotriazine, di- to hexa-methylolmelamine, triglycidylisocyanurate, hydroxyethyl carbamate, methyl carbamate, ethyl carbamate, N-dimethylol-methyl carbamate, oxalic acid diamide and $\beta,\beta',\beta''$-nitrilo-tris-propionic acid amide.

The ethers of these aminoplast precondensates can also be reacted together with the phosphonium compounds. For example, the ethers of alkanols such as methanol, ethanol, n-propanol, isopropanol, n-butanol or pentanols can be used with advantage. However, it is desirable that these aminoplast precondensates should be water-soluble as in the case of, for example, pentamethylolmelamine dimethyl ether or dimethylolurea dimethyl ether.

Preferred amines are primary aliphatic amines, especially alkylamines with at most 22 carbon atoms in the alkyl radical. Further, diamines and polyamines with at least one primary amino group in the molecule or primary amines which contain, for example, alkenyl, hydroxyalkyl or halogenoalkyl radicals, are also suitable.

Examples of other nitrogen compounds are: Dodecylamine, stearylamine, alkylamine, dimethylaminopropylamine, ethylenediamine, diglycolamine, ethanolamine, aniline, diethylenetriamine, triethylenetetramine, tetraethylenepentamine, N-(3-aminopropyl)-morpholine, hydroxyethylethylenediamine, ethylamine, 2,4,6,8,9-pentaazobicyclo-[3,3,1]-nona-2,6-diene and its HCl salt.

The condensation products are manufactured by reacting the tetrakis-(hydroxymethyl)-phosphonium compound with the reactive nitrogen compound, as a rule at 40° to 120°C; only the reaction with the amine is appropriately carried out at higher temperatures, that is to say at 100° to 150°C.

This reaction is optionally carried out in the presence of formaldehyde or of a formaldehyde donor and optionally in the presence of an inert organic solvent. The condensation is optionally subsequently continued at 100° to 150°C and optionally free hydroxyl groups are etherified, at least partially, with at least one alkanol with 1 to 4 carbon atoms and optionally the salts of the condensation products are converted into the corresponding hydroxides.

The condensation is preferably carried out at 70° to 110°C (with the exception of amines), in an inert organic solvent or solvent mixture. For this purpose, aromatic hydrocarbons are above all suitable, such as, for example, toluene, o—, m— or p-xylene or a mixture thereof, or xylene-toluene, xylene-benzene or xylene-decahydronaphthalene mixtures. The optional subsequent further condensation is preferably carried out at 125° to 140°C or especially at about 135°C, that is to say at the boiling point of the solvent or solvent mixture.

In addition it is however also possible to carry out the condensation in the absence of an inert organic solvent, for example by using previously prepared condensation products as the solvent or carrying out the condensation in the melt.

An appropriate procedure is to heat the tetrakis-(hydroxymethyl)-phosphonium compound, which as a rule is in the form of an aqueous solution, together with the nitrogen compound, optionally in a solvent, to the boil and distil off the water.

The formaldehyde which is optionally used conjointly is preferably in the form of an aqueous solution. A possible formaldehyde donor is above all paraformaldehyde.

The etherification of the condensation products which is optionally to be carried out is carried out in the same way as for the self-condensation product. The same is true of the conversion into the corresponding hydroxides. It is also possible to employ the same catalysts for the condensation as those specified for the self-condensation product.

When using amines as reactive nitrogen compounds, fundamentally the same procedure is followed as with the previously mentioned compounds. However, the condensation is never carried out in the presence of formaldehyde and equally a further condensation at elevated temperature is never necessary since the actual condensation is already carried out at 100° to 150°C.

An appropriate procedure is to heat the tetrakis-(hydroxymethyl)-phosphonium compound, which as a rule is in the form of an aqueous solution, to the boil together with the amine, optionally in a solvent, and to distil off the water. This procedure can be carried out continuously or stepwise, that is to say the mixture can be heated immediately to the requisite temperature or the two components can first be brought together at room temperature, for example 15° to 25°C, and only then warmed to 100°–150°C.

The molar ratios of the reactants for the manufacture of the component (1) can vary within wide limits; thus, for example, the ratio of phosphorus compound to nitrogen compound is from 1:1 to 1:0.02.

However, certain molar ratios have proved particularly advantageous for the various reactants. The table which follows shows the number of mols which are appropriately reacted with 1 mol of the tetrakis-(hydroxymethyl)-phosphonium compound, for various nitrogen compounds.

| Nitrogen compound | Molar range |
|---|---|
| Cyanamide | 0.02 – 0.5 |
| Guanidine and guanidine salt | |
| Guanylurea and guanylurea salt | |
| Monocyclic or bicyclic urea | |
| Thiourea | |
| Biuret | |
| Methylol compounds and ethers of the above compounds | |
| Amines | |
| Triglycidylisocyanurate | |
| **Nitrogen compound** | **Molar range** |
| Dicyandiamide | 0.02 – 0.2 |
| Methylolated dicyandiamide and ethers | |
| Urea | |
| Methylolurea | 0.02 – 1 |
| Penta-azo-bicyclo-nonadiene or salt | |
| Amides | |
| Carbamates | |
| Amino-1,3,5-triazines | 0.02 – 0.1 |

The particularly preferred components (1) are THPC as such, THPC condensed with itself, or a condensation product of 1 mol of THPC and 0.02 to 1, preferably 0.5, mol of dimethylolurea.

The agent for imparting a soft handle or the component (2) is preferably a material corresponding to the formula (2)

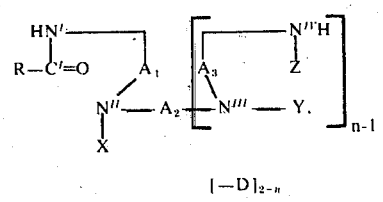

wherein X and Y each denotes hydrogen or $—CONH_2$, Z denotes hydrogen, alkyl with 1 to 4 carbon atoms, $—CONH_2$, $—C''OR'$ or $—A_4—NHCO—R''$, $A_1$, $A_2$, $A_3$ and $A_4$ each denote alkylene with 2 or 3 carbon atoms, D denotes hydrogen, —OH, $—NH_2$, $—CONH_2$ or $—(OCH_2—)_{m-1}—NHCO—R'''$, R, R', R'' and R''' each denote alkyl with 9 to 23 carbon atoms and m and n each denote 1 or 2 and X can also be a covalent bond to $C^I$ if H on $N^I$ and O on $C^I$ are omitted and there is a double bond between $N^I$ and $C^I$, and Y can also be a covalent bond to $C^{II}$ if N=2, Z denotes $—C^{II}—OR'$, H on $N^{IV}$ and O on $C^{II}$ are omitted and there is a double bond, between $N^{IV}$ and $C^{II}$ these softeners optionally being quaternised with alkyl halides or dialkyl sulphates which contain 1 or 2 carbon atoms per alkyl radical or with halogenocarboxylic acid alkyl esters which contain up to 4 carbon atoms in the acid part and up to 22 carbon atoms in the alcohol part and up to 60 carbon atoms if the alkyl chains are interrupted by oxygen atoms, or optionally being in the form of acid salts of alkylcarboxylic acids with at most 4 carbon atoms.

Further advantageous agents for imparting a soft handle are the compounds of the formula (1) which are not the same as the compounds of the formula (2).

The quaternisation products or acid salts are particularly preferred in the case of the agent for imparting a soft handle or of the component (2). Quaternising agents which have proved advantageous are alkyl halides such as methyl bromide or ethyl bromide, but especially methyl chloride or ethyl chloride, dialkyl sulphates such as dimethyl sulphate or diethyl sulphate or halogenocarboxylic acid ester such as esters of chloroacetic acid with polyethylene glycols which are terminally etherified with alkanols such as n-butanol, n-octanol, n-dodecanol or stearyl alcohol. The polyethylene glycols mentioned are preferably those with 2 to 20 ethoxy radicals.

Agents for imparting a soft handle which are of particular interest are imidazolines of the formula (3)

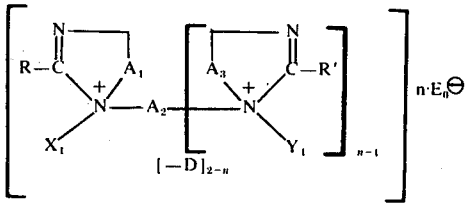

wherein R, R', $A_1$, $A_2$, $A_3$, D and n have the indicated meaning and $X_1$ and $Y_1$ each denote hydrogen, alkyl with 1 or 2 carbon atoms or alkoxycarbonylalkyl with 1 to 4 carbon atoms in the alkyl part and 1 to 22 carbon atoms in the alkoxy part, these latter optionally being interrupted by oxygen atoms in the carbon chain, and $E_o^-$ denotes the monovalent or divalent anion of a hydrogen halide acid, of a dialkyl sulphate with 1 or 2 carbon atoms in the alkyl radical or of an alkylcarboxylic acid with 1 to 4 carbon atoms. Preferred agents for imparting a soft handle are imidazolines of the formula (3) with $E^-$ instead of $E_o^-$, whereby $E^-$ is a monovalent anion of the indicated type.

Other preferred agents for imparting a soft handle are amides of the formula (4)

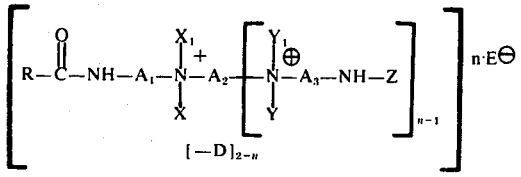

wherein R, $A_1$, $A_2$, $A_3$, X, Y, Z, D, n, $X_1$, $Y_1$ and $E^-$ have the indicated meaning.

Imidazoles which are very suitable correspond to the formula (5)

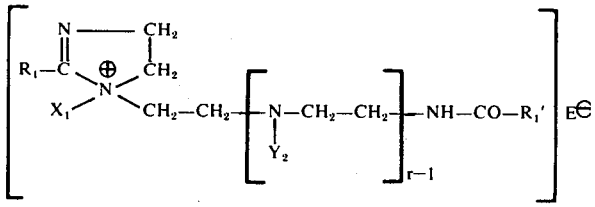

wherein $R_1$ and $R_1'$ each denote alkyl with 15 to 21 carbon atoms, $Y_2$ denotes hydrogen or $—CONH_2$ and r denotes 1 or 2, and $X_1$ and $E^-$ have the indicated meaning.

Advantageous amides correspond to the formula (6)

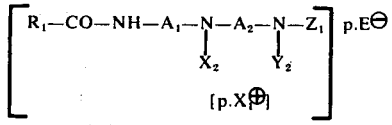

wherein $X_2$ and $Y_2$ each represent hydrogen or $—CONH_2$ and $Z_1$ represents hydrogen, $—CO-R_1'$ or $—A_3—Z_2$ and p is 1 or 2 but is not greater than the number of secondary or tertiary amine nitrogen atoms, $Z_2$ represents hydrogen or $—COR_1'$ and $R_1$, $R_1'$, $A_1$, $A_2$, $A_3$ and $E^-$ have the indicated meaning.

Particularly suitable compounds are the imidazolines which correspond to the formula (6.1)

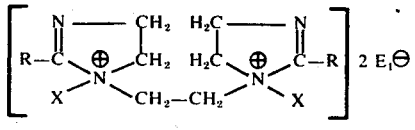

and the imidazoles which correspond to the formula (6.2)

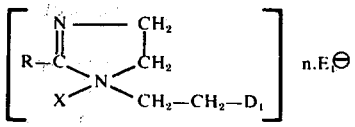

as well as the amides which correspond to the formula (6.3)

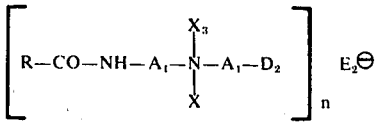

wherein $D_1$ denotes -NH-CO-R or -NH-CO-$NH_2$, $D_2$ denotes $$-OH,\ -CO-NH_2 \text{ or } -(O-CH_2-)_{m+1}-\left(\begin{matrix}CO\\NH\end{matrix}\right)-R'''.$$

and $A_1$, $R_1$, $R'''$, X, m and n have the indicated meaning.

As examples of suitable agents for imparting a soft handle, of the formula (1), there may be mentioned:

(7.1)
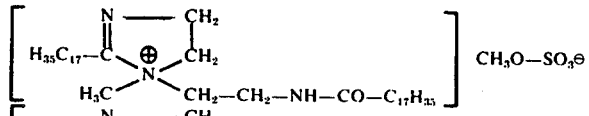

(7.2)
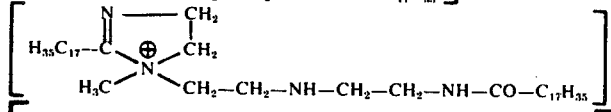

(7.3)
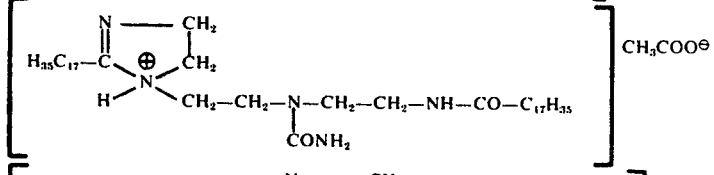

(7.4)
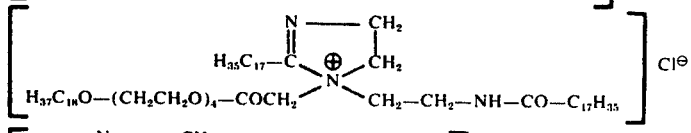

(7.5)
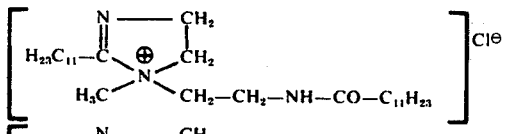

(7.6)
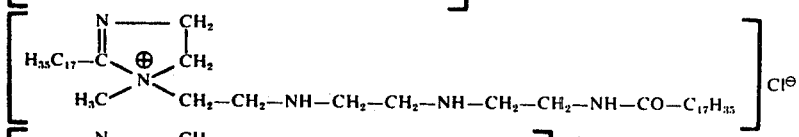

(7.7)
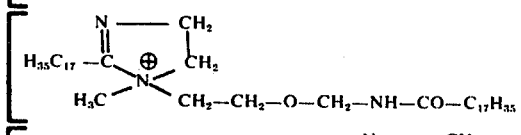

(7.8)
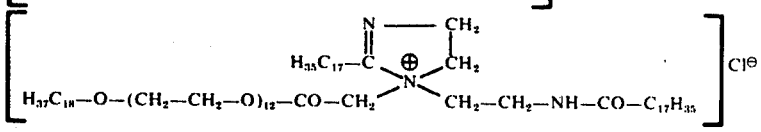

$E_1$ denotes $H_3C-SO_4^-$ or $CH_3COO^-$, $E_2$ denotes $SO_4^{--}$, $CH_3COO^-$ or $Cl^-$, $X_3$ denotes hydrogen, methyl, ethyl or $$-CH_2-\overset{O}{\overset{\|}{C}}-O-C_{12}H_{25}$$

(7.9) The compound (7.8), but quaternized with methyl chloride, (7.10) the compound (7.8), but quaternised with ethyl chloride, (7.11) the compound (7.8), but quaternised with dimethyl sulphate, (7.12) the cmpound (7.8), but quaternised with diethyl sulphate, (7.13)
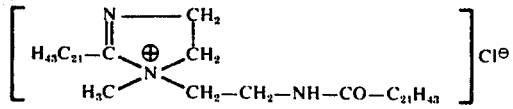

(7.14)
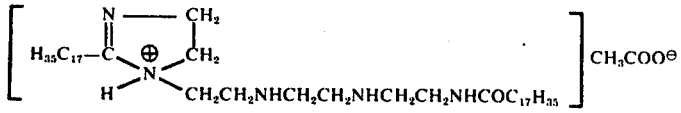

(7.15)
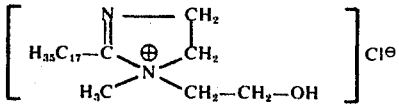

(7.16)
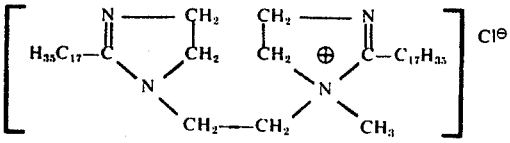

(7.17) 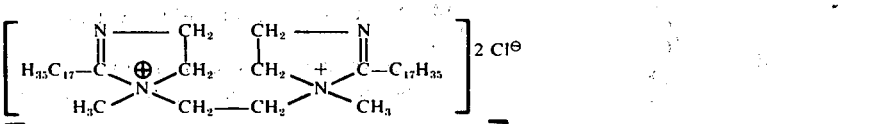
(7.18) 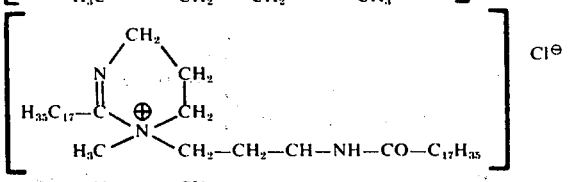
(7.19) 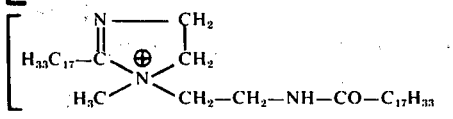
(7.20) 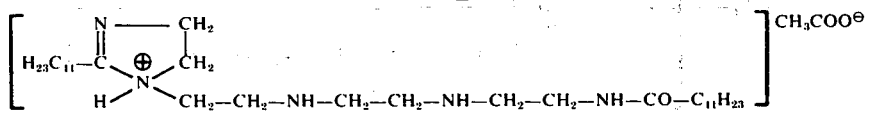
(7.21) 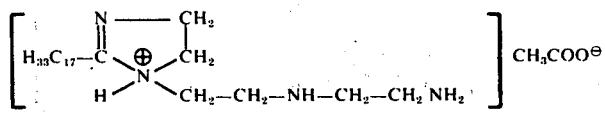
(7.22) 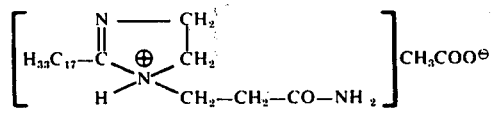
(7.23) 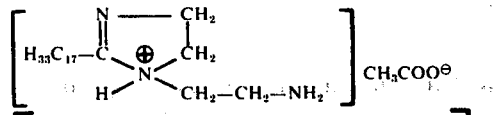
(7.24) 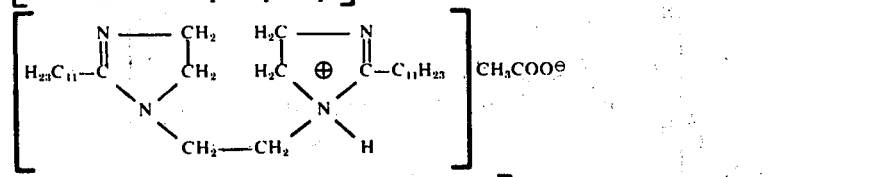
(7.25) 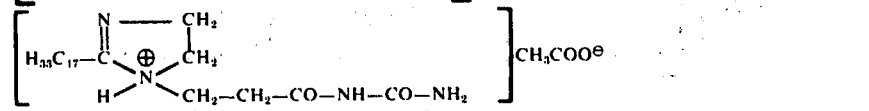
(7.26) 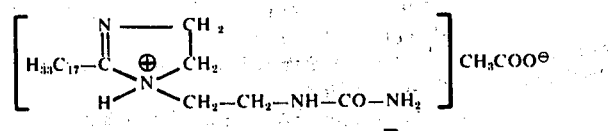
(7.27) 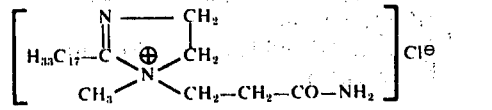
(7.28) 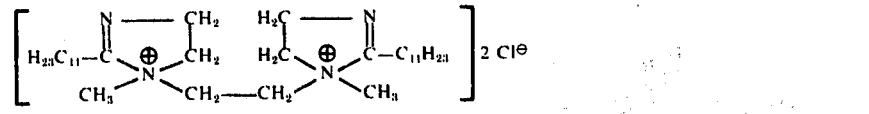
(8.1) 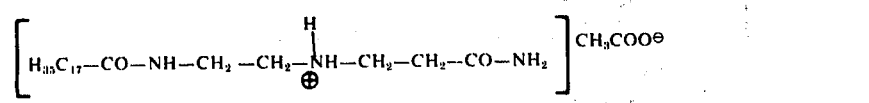
(8.2) 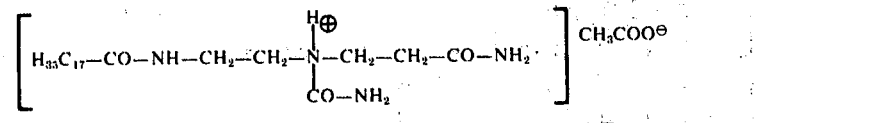
(8.3) 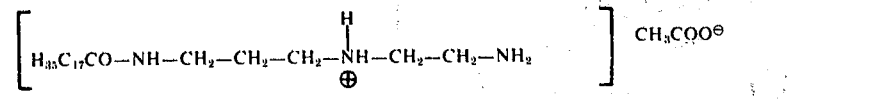

(8.4) $$\left[H_{33}C_{17}-CO-NH-CH_2-CH_2-CH_2-\overset{H\oplus}{\underset{CO-NH_2}{N}}-CH_2-CH_2-CH_2-NH_2\right] CH_3COO^{\ominus}$$

(8.5) $$\left[H_{33}C_{17}-CO-NH-CH_2-CH_2-NH-CH_2-CH_2-\overset{\oplus}{\underset{H}{N}}H-CH_2-CH_2-NH-CO-C_{17}H_{35}\right] CH_3COO^{\ominus}$$

(8.6) $$\left[H_{33}C_{17}-CO-NH-CH_2-CH_2-\overset{H}{\underset{\oplus}{N}}H-CH_2-CH_2-\underset{CO-NH_2}{N}-CH_2-CH_2-\underset{CO-NH_2}{NH}\right] CH_3COO^{\ominus}$$

(8.7) $$\left[H_{33}C_{17}-CO-NH-CH_2-CH_2-\overset{H}{\underset{\oplus}{N}}H-CH_2-CH_2-OH\right] CH_3COO^{\ominus}$$

(8.8) $$\left[H_{33}C_{17}-CO-NH-CH_2-CH_2-\overset{H}{\underset{\oplus}{N}}H-CH_2-CH_2-CO-NH_2\right] CH_3COO^{\ominus}$$

(8.9) $$\left[H_{33}C_{17}-CO-NH-CH_2-CH_2-\overset{H}{\underset{\oplus}{N}}H-CH_2-CH_2-O-CH_2-CO-NH-C_{17}H_{35}\right] CH_3COO^{-}$$

(8.10) $$\left[H_{33}C_{17}-CO-NH-CH_2-CH_2-CH_2-\underset{\underset{CH_3}{\oplus}}{\overset{CH_3}{N}}-CH_2-CH_2-CH_2-NH-CO-C_{17}H_{33}\right] Cl^{\ominus}$$

(8.11) $$\left[R_k-CO-NH-CH_2-CH_2-CH_2-\underset{\underset{CH_3}{\oplus}}{\overset{CH_2-CH_3}{N}}-CH_2-CH_2-CH_2-NH-CO-R_k\right]_2 SO_4^{\ominus}$$

wherein $R_k$ is the hydrocarbon radical of a coconut fatty acid.

(8.12) $$\left[H_{33}C_{17}-CO-NH-CH_2-CH_2-CH_2-\underset{\underset{CH_3}{\oplus}}{\overset{CH_2-CH_3}{N}}-CH_2-CH_2-CH_2-NH-CO-C_{17}H_{33}\right]_2 SO_4^{\ominus}$$

(8.13) $$\left[H_{33}C_{17}-CO-NH-CH_2-CH_2-CH_2-\underset{\underset{CH_3}{\oplus}}{\overset{CH_2-\overset{O}{\overset{\|}{C}}-OC_{12}H_{25}}{N}}-CH_2-CH_2-CH_2-NH-CO-C_{17}H_{33}\right] Cl^{\ominus}$$

Good results are above all provided by the agents for imparting a soft handle, of the formula (7.24), (7.26) and (8.8) to (8.13) and especially by those of the formulae (7.1), (7.28) and (8.7).

The agents for imparting a soft handle, of the formula (1), are known and are manufactured according to known methods. For example, the following general instruction can be followed: 1 mol of an appropriate fatty acid, for example lauric acid, stearic acid, oleic acid or behenic acid, are warmed to the boil with 1 mol of a polyalkylenepolyamine, for example hydroxyethylethylenediamine, diethylenetriamine, dipropylenetriamine, triethylenetetramine or tetraethylenepentamine in an amount of solvent, for example xylene or toluene, which is about twice that corresponding to the fatty acid. 2 mols (monocyclic products), 4 mols (bicyclic products) or 1 mol (acyclic products) of water are now split off azeotropically.

The side chain can be acylated by adding a further mol of a fatty acid, for example to the xylene solution, and azeotropically eliminating water. If further amino groups are present, the acylation can be continued.

Products which contain one asymmetrical urea group in the side chain are obtained by addition of, for example, one mol of carbamic acid methyl ester (instead of fatty acid as above) to the xylene-free reaction product and warming until 1 mol of methanol distillate can be collected. If yet further amino groups are present, further urea groups can be introduced in this way.

The component (3) is a water-soluble 1,3,5-triazine which possesses 2 to 4 methylol groups, and these methylol groups can optionally be etherified with alkanols with 1 to 4 carbon atoms, for example n-butanol, tert.-butanol, n-propanol, ethanol or especially methanol. Accordingly, preferred triazines are water-soluble dimethylolmelamines or trimethylolmelamines, or mixtures thereof, which are optionally etherified with an alkanol with 1 to 4 carbon atoms.

Dimethylolmelamine, trimethylolmelamine, trimethylolmelamine monomethyl ether or trimethylolmelamine dimethyl ether or mixtures of individual examples of these melamines are particularly suitable.

The component (4) which is optionally used conjointly can be, for example, one of the following compounds which are optionally methylolated and optionally etherified with an alkanol with 1 to 4 carbon atoms: cyanamide, dicyandiamide, guanidine, biuret or urea and especially their ethyl ethers or methyl ethers.

Preferably, cyanamide, dicyandiamide, guanidine, biuret or urea are used conjointly as optionally methylolated compounds.

Biuret, urea or especially a methylolurea, that is to say above all dimethylolurea, are of outstanding interest.

In certain cases it has proved desirable also to add a component (5) to the flameproofing preparation. The low molecular amines optionally used for this purpose are preferably simple aliphatic or heterocyclic amines such as, for example, allylamine, ethylamine, diethanolamine and triethanolamine, propylamine, pyrrolidine, piperidine and 1,2,5,6-tetrahydropiperidine. The secondary and tertiary amines are preferred to the primary amines. Low molecular amines are as a rule understood as amines of molecular weight not exceeding 100. The heterocyclic amines such as pyridine are of particular interest.

Combinations which have proved of very particular interest are, on the one hand, self-condensation products of THPC or condensation products of THPC and dimethylolurea and agents for imparting a soft handle, of the formulae (7.1), (7.28) or (8.7), and, on the other hand, THPC as such, dimethylolurea and/or piperidine and agents for imparting a soft handle, of the formula (7.1), (7.28) or (8.7).

The aqueous flameproofing preparations as a rule contain 200 to 750 g/l, preferably 200 to 600 g/l, and especially 350 to 450 g/l, of the component (1), 3 to 20 g/l, preferably 5 to 10 g/l, of the component (2), 20 to 200 g/l, preferably 70 to 140 g/l, of the component (3), 0 to 120 g/l, preferably 10 to 120 g/l, or especially 30 to 100 g/l, of the component (4) and 0 to 100 g/l, preferably 10 to 100 g/l or especially 20 to 70 g/l, of the component (5).

Frequently, but especially on relatively thin fabrics of high polyester content (for example 67:33), it has proved advantageous to use large amounts of the component (1), up to 750 g/l, for example 600 to 750 g/l or above all 600 to 700 g/l.

The preparation in most cases have an acid to neutral or weakly alkaline pH value which as a rule is 2 to 7.5, preferably 4 to 7, and is adjusted in the usual way by adding bases or acids.

The preparations for flameproofing can optionally contain yet further additives. To achieve a heavier deposit of material on fabrics it is advantageous, for example, to add from 0.1 to 0.5 percent o of a high molecular polyethylene glycol. Other customary plasticisers, for example an aqueous polyethylene emulsion or silicone emulsion, can also be added to the preparations.

To improve the mechanical strengths of the fibres, suitable copolymers can also be added to the preparations, for example copolymers of N-methylolacrylamide or cationic copolymers. Examples of advantageous preparations are aqueous emulsions of copolymers of a) 0.25 to 10 percent of an alkaline earth metal salt of an $\alpha,\beta$-ethylenically unsaturated monocarboxylic acid, b) 0.25 to 30 percent of a N-methylolamide or N-methylolamide ether of an $\alpha,\beta$-ethylenically unsaturated monocarboxylic acid or dicarboxylic acid and c) 99.5 to 60 percent of at least one other copolymerisable compound.

These copolymers, and their manufacture, are known. The tensile strength and abrasion resistance of the treated fibrous material can be advantageously influenced by the conjoint use of such a copolymer.

If a polymer of the indicated type is added to the preparation, the amounts are advantageously small, for example 1 to 10 percent, relative to the amount of the phosphorus-containing condensation product or self-condensation product.

It is also possible to add curing catalysts such as, for example, ammonium chloride, ammonium dihydrogen orthophosphate, phosphoric acid, magnesium chloride or zinc nitrate, but in most cases this is not necessary.

It can also be advantageous to add buffer substances, for example $NaHCO_3$, disodium phosphate and trisodium phosphate and triethanolamine.

To improve the durability of the flameproof finishes and to achieve an even softer handle it can be advantageous to add, to the aqueous preparations, halogenated paraffins in combination with a polyvinylhalogen compound.

Furthermore, the preparations can also still contain proportions of organic solvents which above all serve as solubilising agents for the plasticiser, such as, for example, dioxane, acetone, n-butyl glycol, isopropanol, ethanol or ethyl acetate.

It can also be advantageous to add small amounts (for example 0.5–2 g/l) of wetting agents to the preparations, for example non-ionic adducts of ethylene oxide to an alkylphenol such as, for example, a condensation product of 1 mol of p-tert.-nonylphenol and 6 to 12 mols of ethylene oxide.

The fibre materials to be provided with a flameproof finish are preferably textiles. In particular, fibre materials of cellulose/polyester or cellulose or polyester are flameproofed, fibre mixtures or mixed fabrics of polyester/cellulose, especially those wherein the ratio of the proportion of polyester to the proportion of cellulose is from 1:4 to 2:1, being preferred. Thus, for example, so-called 20/80, 26/74, 50/50 or 67/33 polyester/cellulose and above all polyester/cotton fibre mixtures can be used.

The cellulose or the cellulose constituent of the fibre material originates, for example, from linen, cotton, rayon or viscose staple.

The preparations are now applied to the fibre materials and this can be effected in a manner which is in itself known. Preferably, piece goods are used and impregnated on a padder which is fed with the preparation at room temperature.

In the preferred thermofixing process, the fibre material impregnated in this way must now be dried and subjected to a heat treatment. It is appropriately dried at temperatures of up to 100°C, for example 40° to 100°C. The material is then subjected to a heat treatment at temperatures above 100°C, for example 100° to 200°C, preferably 120° to 180°C, the duration of which can be the shorter, the higher is the temperature. This duration of heating is, for example, 30 seconds to 10 minutes.

Furthermore it is also possible to use the socalled moist fixing or wet fixing process or the ammonia fixing process.

If the moist fixing process is used, the fabric is first dried to a residual moisture content of about 5 to 20 percent and is then stored for 12 to 48 minutes at about 40° to 60°C, rinsed, washed and dried. In the wet fixing process, a similar procedure is followed except that the completely wet fibre material is stored. In the ammonia fixing process, which next to the thermofixing process is the most frequently encountered process, the treated fibre material is first gassed with ammonia whilst moist, preferably rinsed in an ammonia solution, and then dried.

An oxidative rinse with a hydrogen peroxide solution which has been rendered alkaline can be performed in order to eliminate any unpleasant residual odour of the finished fibre material. However, if the finishing preparation contains, as component (2), an agent for imparting a soft handle which has been prepared from unsaturated fatty acids, such as oleic acid, the residual odour of the finished fibre material is reduced to the point that an oxidative rinse can optionally be dispensed with.

A rinse with an acid-binding agent, preferably with aqueous sodium carbonate solution, can be desirable in the case of a strongly acid reaction medium.

In the examples which follow, the percentages and parts are parts by weight and percentages by weight. The relationship of parts by volume to parts by weight is as of the ml to the g.

MANUFACTURING INSTRUCTIONS 1. 1,750 parts of a 78 percent strength aqueous solution of THPC (= 7.15 mols of THPC) and 1,000 parts of m-xylene are warmed to the boil, with rapid stirring, in a stirred flask of 4,000 parts by volume capacity which is equipped with a reflux condenser, thermometer and water separator. The azeotropic removal of the water from the aqueous THPC solution starts at a boiling point of 104°C. The calculated amount of water of 385 parts is obtained over the course of 3 hours and the boiling point reaches 131°C.

A further 145 parts of water, which have been produced with simultaneous slight elimination of HCl through self-condensation of the dehydrated THPC, are now removed azeotropically by additional treatment for a further 9½ hours at 135°C. This amount of water corresponds to approximately 1.1 mols of water per mol of THPC. The mixture is then cooled to 60°C and diluted with 1,000 parts of methanol, whereupon the viscous condensation product dissolves. The m-xylene/methanol mixture is then removed in vacuo at 60° to 70°C.

1,127 parts of a condensation product in the form of a colourless slightly turbid highly viscous resin are obtained. The product contains 18.6 percent of phosphorus (THPC = 16.3 percent P) and is soluble in water in all proportions, to give a clear solution. The viscosity at 25°C is 2,030 poises.

The addition of an aqueous solution of sodium laurylsulphate to the aqueous solution of the condensation product produces a precipitate, which confirms the highermolecular cationic character of the condensation product prepared according to the invention. Water-insoluble condensation products cannot be obtained with ammonia.

2. The procedure described in Instruction 1 is followed but after completion of the condensation reaction the mixture is only cooled to 90°C and the reaction product is dissolved by adding 800 parts of water; the mixture is then cooled to room temperature, the aqueous solution is separated from the xylene phase and the water is again removed, in vacuo. It can be advantageous to leave a part of the water in the product (that is to say, for example, to prepare an 80 percent strength aqueous solution), which permits convenient handling.

1,515 parts of a clear, slightly syrupy solution, containing 80 percent of condensation product, are thus obtained. To improve the storage stability, the aqueous solution can be buffered to pH 6 to 7, for example by addition of trisodium phosphate or triethanolamine.

3. 78 parts of anhydrous THPC (previously dehydrated azeotropically in benzene) are suspended in 200 parts of m-xylene in a stirred flask of 500 parts by volume capacity equipped with a reflux condenser, thermometer and water separator, and the suspension is heated to the boiling point of 134° to 135°C. Over the course of 3 hours, a total of 7.4 parts of water is obtained by self-condensation, this amount corresponding precisely to 1 mol of water per mol of THPC. After cooling to 90°C, the resinous condensation product is dissolved by adding 47 parts of water. The mixture is then cooled to room temperature, the xylene phase is separated off and the aqueous solution is concentrated in vacuo at 50° to 60°C to the point that an 80 percent strength syrupy colourless product is obtained.

Yield: 87 parts (80 percent strength).

4. 190.5 parts (1 mol) of crystalline anhydrous THPC (dehydrated in benzene) are first introduced into a stirred vessel of 500 parts by volume capacity which is provided with a thermometer, water separator and reflux condenser with vacuum connection, and warmed to 135°C internal temperature whilst stirring. The product melts at 80°C.

As soon as the temperature of 135°C has been reached, the apparatus is placed under a vacuum of 20 to 30 mm Hg by attaching the vacuum connection to the upper end of the reflux condenser. After a total of 3 hours' reaction time at 135°C the condensation is complete and 19 parts (about 1.05 mols) of water have been collected in the water separator. After cooling to room temperature, a very viscous, colourless, clear resin is obtained, which is soluble in water or methanol.

5. 200 parts of the condensation product described in Instruction 4 are dissolved in 100 parts of methanol in a stirred vessel of 500 parts by volume capacity, which is provided with a thermometer and reflux condenser, and are etherified for 30 minutes at the reflux temperature (62°C), whilst stirring. The solution has a pH of approx. 1.

It is then cooled to 40° – 45°C and the excess methanol is removed in vacuo. 210 parts of partially etherified self-condensation product, which has a less high viscosity than the starting product and gives a clear solution in dimethylformamide at 25°C, are obtained.

6. 244 parts of 78 percent strength THPC (= 1 mol of pure substance), 3.81 parts of magnesium chloride as a catalyst (= 2% relative to pure THPC) and 160 parts by volume of toluene are introduced into a stirred vessel of 500 parts by volume capacity which is provided with a thermometer, reflux condenser and water separator. The mixture is boiled under reflux, whilst stirring, until 1 mol of water (18 parts by volume) has been separated off, which requires about 10 to 12 hours.

The solvent is then removed in a rotary evaporator under reduced pressure. The reaction product is left as a turbid, slightly coloured, viscous syrup, in practically 100 percent yield.

7. 190.5 parts of THPOH (1.11 mols), prepared from THPC by neutralisation with aqueous NaOH and subsequent dehydration are heated to the boil with 3.81 parts of $MgCl_2$ (2 percent relative to THPOH) in 160 parts by volume of m-xylene, whilst stirring, until no further water separates off. 13 parts by volume of water (0.72 mol) are separated off in this way.

After evaporation of the solvent, the self-condensation product is left as a viscous syrup in 93 percent yield.

The self-condensation product is water-soluble.

8. 238 parts of an 80 percent strength aqueous THPC solution and 200 parts of m-xylene are dehydrated and condensed, in a stirred vessel of 500 parts by volume capacity which is provided with a thermometer and water separator, in an analogous manner to that in Instruction 1. 73 parts of water are obtained.

The viscous condensation product freed of xylene and methanol is again diluted with water to 80 percent solids content and is neutralised to pH 7.5 with 49.5 parts of a 30 percent strength aqueous sodium hydroxide solution.

During the neutralisation, the temperature is kept at 15° to 20°C by cooling. The resulting solution contains 63 percent of active substance which is partly in the form of the hydroxide and partly in the form of the chloride.

9. 73.5 parts of a 78 percent strength aqueous solution of THPC (= 300 mols) and 42 parts of 1,3-xylene are warmed to the boil, with rapid stirring, in an enamelled stirred kettle of 160 parts by volume capacity which is provided with a water separator and thermometer. The azeotropic removal of the water commences at a boiling point of 103°C. The calculated amount of water of 16.2 parts is obtained over the course of 3½ hours and the boiling point reaches 131°C.

A further 5.1 parts of water are now removed azeotropically by an additional treatment for a further 7½ hours at 136° to 137°C, this water having been produced, with simultaneous slight elimination of HCl, by self-condensation of the dehydrated THPC. This amount of water corresponds to about 0.95 mol of water per mol of THPC. The mixture is then cooled to 60°C, the stirrer is switched off and the supernatant xylene is siphoned off as far as possible. The residue is dissolved in 13.5 parts of water and at the same time cooled to 15°C, whilst stirring. The pH is adjusted to 6 by adding 13.5 parts of 30 percent strength aqueous sodium hydroxide solution and the mixture is then distilled in vacuo at 50°C until the distillate contains no further xylene.

After cooling to 20°C, the product is filtered through felt, by application of pressure, in order to isolate the sodium chloride which has separated out.

69 parts of a dark red, clear solution containing 64.5 percent of active substance and 5.5 percent of sodium chloride are obtained. The pH of the solution is 6.

10. 170 parts of the condensation product described in Instruction 1 and 54.2 parts of 2,3-dibromopropanol are dissolved in 55 parts of dimethylformamide in a stirred vessel of 500 parts by volume capacity which is equipped with a reflux condenser and thermometer, and are stirred for 1 hour at 100° to 105°C. The dimethylformamide is then distilled off in vacuo at 70° to 80°C.

The residue is dissolved in 400 parts of water and the solution is freed of water and unreacted 2,3-dibromopropanol in vacuo at 90° to 95°C.

209 parts of a yellow, liquid of low viscosity, which is the condensation product from Instruction 1 partially etherified with 2,3-debromopropanol, are obtained.

11. 235 parts (1 mol) of tetrakis-hydroxymethylphosphonium bromide are suspended in 500 ml of xylene. The suspension is heated to the boil until no further water separates off; in total, about 12 ml (0.66 mol) of water are separated off. The xylene is then evaporated under reduced pressure and the product is obtained as a yellow-brown viscous oil which is used without further purification.

12. 340 parts of an anhydrous self-condensation product prepared according to Instruction 1 and 60 parts of urea are dissolved in 600 parts of water in an open stirred vessel of 3,000 parts by volume capacity which is equipped with a thermometer. The mixture is warmed to 95° – 98°C internal temperature with rapid stirring, in the course of which intense gelling gradually occurs. The gelled product is dried in vacuo at 90°C and then powdered. Yield: 332 parts of a white, water-insoluble powder which contains 8.1% N and 17.5% P.

13. 480 parts of an anhydrous self-condensation product prepared according to Instruction 1 and 160 parts of melamine in 1,000 parts of water are warmed, in an open stirred vessel of 3,000 parts by volume capacity, equipped with a thermometer, to 85°C internal temperature, with rapid stirring, in the course of which a clear solution is gradually produced. The temperature is then raised to 95°C, whereupon a sudden intense gelling occurs. The gelled product is processed further analogously to Instruction 12. Yield: 534 parts of a white, water-insoluble powder which contains 18.9% N and 15.2% P.

14. 264 parts of a 64.5% strength aqueous solution of the self-condensation product prepared according to Instruction 9 are diluted with 165 parts of water in a stirred vessel of 500 parts by volume capacity which is equipped with a thermometer, and 90 parts of guanidine carbonate are added over the course of 30 minutes at 20°C internal temperature. The solution is then stirred for 72 hours at room temperature and the water is thereafter removed in vacuo at 50°C. 213 parts of a partly solid condensation product are obtained and are made up to a 50 percent strength solution with 213 parts of water.

15. 132 parts of a 64.5 percent strength aqueous solution of the self-condensation product prepared according to Instruction 9, and 42.25 parts of 3-(dimethylphosphono)-propionic acid amide are dissolved in 83 parts of water in a stirred vessel of 500 parts by volume capacity, which is equipped with a thermometer and reflux condenser, and the mixture is condensed for 2 hours at 90° to 100°C internal temperature.

260 parts of a yellow solution of low viscosity is obtained, which contains 45 percent of condensation product.

16. 244 parts of a 78 percent strength aqueous solution of THPC (1 mol of THPC), 10.5 parts of cyanamide (0.25 mol) and 200 parts of a xylene isomer mixture are heated to the boil, with rapid stirring, in a stirred vessel of 500 parts by volume capacity which is equipped with a water separator and thermometer. The azeotropic removal of the water from the aqueous THPC solution commences at a boiling point of 102°C. After removing this water (53.5 parts), the boiling point of the xylene is 130°C. A further 22 parts of water are now removed azeotropically by additional treatment at 130°C, after which the condensation product forms a highly viscous mass. The product is cooled to 90°C and dissolved by adding 200 parts of water and the xylene is largely stripped off. The aqueous solution is completely evaporated in vacuo at 70°C. 168 parts of a highly viscous colourless condensation product, which in aqueous solution gives a heavy precipitate with ammonia, are obtained.

Analysis shows a P content of 17.2 percent and a N content of 3.7 percent.

17. 244 parts of a 78 percent strength aqueous solution of THPC (1 mol) are neutralised, in a stirred vessel of 500 parts by volume capacity, which is equipped with a thermometer and reflux condenser, with 55.6 parts of 30 percent strength sodium hydroxide solution to a pH value of 7.2 and 21 parts of cyanamide (0.5 mol) are then added. The condensation is then carried out for 2 hours at 100 to 110°C internal temperature. After cooling, a yellow, clear precondensate of low viscosity, which contains 63 percent of active substance, is obtained.

18. 244 parts of a 78 percent strength aqueous THPC solution (1 mol of THPC), 10.5 parts of dicyandiamide (0.125 mol) and 200 parts of xylene isomer mixture are heated to the boil with rapid stirring, in a stirred vessel of 500 parts by volume capacity which is provided with a water separator and thermometer. The azeotropic removal of the water from the aqueous THPC solution and of the water formed by condensation (a total of 79 parts of water) commences at a boiling point of 102°C. After removal of this amount of water the boiling point rises to 130°C without, however, further water being formed. The mixture is cooled to 90°C, the product is dissolved by adding 200 parts of water and the xylene is largely stripped off. The aqueous solution is completely evaporated in vacuo at 70°C.

166 parts of a yellow, viscous, condensation product, which in aqueous solution forms a gel with ammonia but does not give a precipitate, are obtained.

19. 244 parts of a 78 percent strength aqueous solution of THPC (1 mol) and 10.5 parts of dicyandiamide (0.125 mol) are treated for 2 hours at 100° to 110°C internal temperature in a stirred vessel of 500 parts by volume capacity, which is equipped with a thermometer and reflux condenser. The water is then removed in vacuo at 60°C.

190 parts of a yellowish viscous condensation product containing 15.5% P and 3.4% N are obtained.

20. The procedure described in Instruction 19 is followed, but 11.4 parts (0.1 mol) of monomethyloldicyandiamide are used instead of the dicyandiamide.

194 parts of a crystalline white condensation product which contains 15.9% P are obtained.

21. 244 parts of a 78 percent strength aqueous solution of THPC (1 mol) and 7.5 parts of urea (0.125 mol) are treated for 2 hours at 100°–110°C internal temperature in a stirred vessel of 500 parts by volume capacity equipped with a thermometer and reflux condenser.

The reaction product is in the form of a clear solution which contains 77 percent of condensation product.

22. 488 parts of a 78 percent strength aqueous THPC solution (2 mols), 2.4 parts of urea (0.04 mol) and 400 parts of toluene are heated to the boil, with rapid stirring, in a stirred vessel of 1,000 parts by volume capacity, which is equipped with a water separator and thermometer. At a boiling point of 91°C, the azeotropic removal of the water from the aqueous THPC solution, and of the water formed by the condensation (a total of 108.5 parts of water) commences. After removing this amount of water, the boiling point is 107°C without, however, further water being formed. The mixture is cooled to 90°C, the product is dissolved by adding 200 parts of water and the toluene is largely stripped off. The aqueous solution is completely evaporated in vacuo at 70°C.

384 parts of a reddish, partially crystalline condensation product are obtained.

23. 192 parts of the condensation product obtained in Instruction 22 are dissolved in 80 parts of methanol in a stirred vessel of 500 parts by volume capacity, which is equipped with a reflux condenser and thermometer, 0.1 part of concentrated aqueous HCl is added and the etherification is carried out for 30 minutes at the reflux temperature (65°–66°C). The excess methanol is subsequently removed in vacuo at 50°C.

219 parts of a reddish-coloured pasty product are obtained.

24. 244 parts of a 78 percent strength aqueuos solution of THPC (1 mol) and 60 pats of dimethylolurea (0.5 mol) are treated for 2 hours at 100° to 110°C internal temperature in a stirred vessel of 500 parts by volume capacity which is equipped with a thermometer and reflux condenser.

The reaction product is in the form of a clear, colourless solution of low viscosity which contains 76.5 percent of condensation product.

25. 244 parts of a 78 percent strength aqueous THPC solution (1 mol), 36 parts of monomethylolurea (0.4 mol) and 200 parts of xylene isomer mixture are heated to the boil, with rapid stirring, in a stirred vessel of 500 parts by volume capacity, which is provided with a water separator and thermometer. At a boiling point of 102°C the azeotropic removal of the water from the aqueous THPC solution and of the water formed by condensation (a total of 76 parts of water) commences. After removal of this amount of water the boiling point reaches 132°C without, however, further water being formed. The mixture is cooled to 90°C, the product is dissolved by adding 200 parts of water and the xylene is largely stripped off. The aqueous solution is completely evaporated in vacuo at 70°C. 185 parts of a highly viscous condensaton product are obtained.

26. 244 parts (1 mol) of a 78 percent strength aqueous solution of THPC and 120 parts of dimethylolurea (1 mol) are warmed in a stirred vessel of 500 parts by volume capacity, which is provided with a reflux condenser and thermometer, from 25°C to 95°C over the course of 15 minutes. At 95°C, the reaction mixture forms a colourless clear solution which is immediately cooled again to room temperature by means of ice.

Yield: 364 parts of clear, colourless solution of low viscosity.

Content of active substance: 80 percent by weight.

27. 244 parts of a 78 percent strength aqueous solution of THPC (1 mol) are neutralised, in a stirred vessel of 500 parts by volume capacity which is equipped with a thermometer and reflux condenser, to a pH value of 7.2 with 60 parts of 30 percent strength aqueous sodium hydroxide solution and 24 parts of dimethylolurea (0.2 mol) are then added. The condensation is then carried out for 2 hours at 100°–110°C internal temperature and thereafter the water is remoed in vacuo at 60°C.

205 parts of a syrupy condensation product containing 26 parts of NaCl are obtained.

28. 190.5 parts (1 mol) of crystalline anhydrous THPC and 2.4 parts (0.02 mol) of dimethylolurea are condensed in the melt for 2 hours at 105°C internal temperature in a stirred vessel of 500 parts by volume capacity which is equipped with a reflux condenser and thermometer. After cooling, 192 parts of a crystalline condensation product are obtained.

29. 47 parts (0.2 mol) of tetrakishydroxymethylphosphonium bromide and 9.6 parts (0.08 mol) of dimethylolurea are mixed with 11.75 parts of water in a stirred vessel of 200 parts by volume capacity which is equipped with a thermometer and reflux condenser, and are condensed for 2 hours at 100°–105°C. After cooling to room temperature, 63 parts of a yellow-coloured solution, of low viscosity, of the condensation product are obtained.

30. 244 parts of a 78 percent strength aqueous THPC solution (1 mol), 43 parts of ethyleneurea (0.5 mol) and 200 parts of xylene isomer mixture are heated to the boil, with rapid stirring, in a stirred vessel of 500 parts by volume capacity which is equipped with a water separator and thermometer. The azeotropic removal of the water from the aqueous THPC solution commences at a boiling point of 102°C. After removal of this water, the boiling point gradually rises to 134°C, whilst further water, formed by condensation, is obtained. In total, 80 parts of water are obtained. The reaction product forms a highly viscous mass and is cooled to 90°C, after which the product is dissolved by adding 200 parts of water. The xylene is largely separated off and the aqueous solution is completely evaporated in vacuo at about 70°C.

200 parts of a yellow highly viscous product are obtained, this is diluted with water to 80 percent active substance, to facilitate handling.

31. 244 parts of a 78 percent strength aqueous solution of THPC (1 mol of THPC) and 50 parts of propyleneurea (0.5 mol) are treated for 2 hours at 100°C internal temperature in a stirred vessel of 500 parts by volume capacity which is equipped with a thermometer and reflux condenser. The mixture is then cooled to room temperature and 293 parts of a clear, colourless solution containing 81.6 percent of active substance are obtained.

32. 244 parts of a 78 percent strength aqueous solution of THPC (1 mol of THPC) and 35.5 parts (0.25 mol) of acetylenediurea are treated for 2 hours at 100°C internal temperature in a stirred vessel of 500 parts by volume capacity which is equipped with a thermometer and reflux condenser. 279 parts of a colourless solution of low viscosity containing 89.6 percent of active substance are obtained.

33. 244 parts of a 78 percent strength aqueous solution of THPC (1 mol of THPC) and 222.5 parts of a 40 percent strength aqueous solution of N,N'-dimethylolglyoxalurea (0.5 mol) are treated for 2 hours at 100° to 105°C internal temperature in a stirred vessel of 500 parts by volume capacity which is equipped with a thermometer and reflux condenser. The mixture is then cooled to room temperature and 463 parts of a yellow-red solution of low viscosity which contains 56 percent of active substance are obtained.

34. 244 parts of a 78 percent strength by weight aqueous solution of tetrakishydroxymethylphosphonium chloride (1 mol) are warmed to 80°c in a stirred vessel of 500 parts by volume capacity which is equipped with a thermometer, water separator and dropping funnel. 9 parts of dodecylamine (0.05 mol) are then added over the course of 20 minutes, while stirring rapidly. After completion of the dropwise addition, the mixture is stirred for a further 10 minutes, 200 parts of xylene are then added and the whole is warmed to the boiling point. The azeotropic removal of the water commences at 102°C. In the course of separating off the water, the internal temperature reaches 134°C and a total of 71 parts of water are obtained. The condensation product is a viscous mass and is dissolved by adding 200 parts of water. The xylene is siphoned off as far as possible and the aqueous solution is again freed of water and residual amounts of xylene in vacuo at 70°C. 162 parts of a yellowish highly viscous product which gives a clear solution in water and does not give a precipitate with ammonia are obtained.

35. 244 parts (1 mol) of a 78 percent strength aqueous THPC solution are initially introduced into a stirred vessel of 500 parts by volume capacity which is equipped with a reflux condenser and thermometer, and are cooled to 5°C. 15.2 parts (0.25 mol) of 98.5 percent strength ethylenediamine are then added dropwise over the course of 10 minutes whilst stirring rapidly and cooling with ice, in the course of which the temperature rises to 13°C. The condensation is then allowed to take place for 2 hours at 100°–110°C. After cooling, 255 parts of a clear, yellow solution of low viscosity, containing 76 percent of active material are obtained.

36. 244 parts (1 mol) of a 78 percent strength aqueous THPC solution are cooled to 0°C in a stirred vessel of 500 parts by volume capacity which is equipped with a reflux condenser and thermometer. 25.5 parts (0.25 mol) of 3-dimethylaminopropylamine are added dropwise over the course of 30 minutes whilst stirring rapidly and cooling with ice, in the course of which the temperature rises to 3°C. The condensation is then allowed to take place for 2 hours at 100°–115°C. After cooling, 262.5 parts of a yellowish solution of low viscosity are obtained. The content of active substance is 78 percent.

37. 244 parts (1 mol) of a 78 percent strength aqueous THPC solution are cooled to 10°C internal temperature in a stirred vessel of 500 parts by volume capacity which is equipped with a water separator, reflux condenser and thermometer, and 21 parts (0.2 mol) of diglycolamine are then added dropwise over the course of 5 minutes whilst stirring well and cooling with ice. In the course thereof, the temperature rises to 16°C. 200 parts of xylene isomer mixture are then added and the mixture is warmed to the boil. The azeotropic removal of the water starts at 104°C. In the course of separating off the water, the internal temperature reaches 132°C and the mixture is cooled as soon as 75 parts of water have been separated off. The highly viscous condensation product is dissolved by adding 200 parts of water. The xylene is siphoned as far as possible and the aqueous solution is again freed of water and residual amounts of xylene in vacuo at 70°C. A viscous condensation product is obtained, which is diluted with water to 80 percent active substance content, to facilitate handling. Yield: 225.5 parts at 80 percent strength.

38. 244 parts (1 mol) of a 78 percent strength aqueous THPC solution are cooled to 0°C in a stirred vessel of 500 parts by volume capacity which is equipped with a reflux condenser and thermometer. 15.25 parts (0.25 mol) of monoethanolamine are added dropwise over the course of 20 minutes whilst stirring rapidly and cooling with ice, in the course of which the temperature rises to 3°C. The condensation is then allowed to take place for 2 hours at 100°–105°C. After cooling, 255 parts of a yellowish solution of low viscosity are obtained. The content of active substance is 80.5 percent.

39. 244 parts (1 mol) of a 78 percent strength aqueous THPC solution are cooled to 0°C in a stirred vessel of 500 parts by volume capacity which is equipped with a reflux condenser and thermometer. 18.6 parts (0.2 mol) of aniline are added dropwise over the course of 5 minutes whilst stirring rapidly and cooling with ice, the temperature rising to 5°C. The condensation is then allowed to take place for 2 hours at 100°–110°C. After cooling, 259 parts of a red solution of low viscosity are obtained. The active substance content is 75.8 percent.

40. 244 parts (1 mol) of a 78 percent strength aqueous THPC solution are cooled to 0°C in a stirred vessel of 500 parts by volume capacity which is equipped with a reflux condenser and thermometer. 11.2 parts (0.1 mol) of 92.1 percent strength diethylenetriamine are added dropwise over the course of 10 minutes whilst stirring rapidly and cooling with ice, the temperature rising to 9°C. The condensation is then allowed to take place for 2 hours at 100°–115°C. After cooling, 251.5 parts of a yellow liquid of low viscosity are obtained. The active substance content is 80.2 percent.

41. 244 parts (1 mol) of a 78 percent strength aqueous THPC solution are cooled to 0°C in a stirred vessel of 500 parts by volume capacity which is equipped with a reflux condenser and thermometer. 14.4 parts (0.1 mol) of N-(3-aminopropyl)-morpholine are added dropwise over the course of 8 minutes whilst stirring rapidly and cooling with ice, the temperature rising to 4°C. The condensation is then allowed to take place for 2 hours at 110°–112°C. After cooling, 253.5 parts of a yellow liquid of low viscosity are obtained. The active substance content is 81.8 percent.

42. 180 parts (0.945 mol) of anhydrous crystalline THPC and 5.09 parts (0.0189 mol) of stearylamine are condensed for 2 hours in the melt at 105°–115°C in a stirred vessel of 500 parts by volume capacity which is equipped with a reflux condenser and thermometer. The mixture is then cooled to 50°C internal temperature, 80 parts of methanol and 0.1 part of 37 percent strength aqueous HCl are added and the mixture is etherified for 30′ at the reflux temperature (63°–64°C). After cooling to 50°C, the excess methanol is removed in vacuo. 181 parts of a pasty condensate which gives an opalescent solution in warm water are obtained.

43. 244 parts of a 78 percent strength aqueous THPC solution (1 mol of THPC), 19 parts of thiourea (0.25 mol) and 200 parts of a xylene isomer mixture are heated to the boil, with rapid stirring, in a stirred vessel of 500 parts by volume capacity which is equipped with a water separator and thermometer. The azeotropic removal of the water from the aqueous THPC solution starts at a boiling point of 105°C. After removing this water (53.3 parts) the boiling point of the xylene is 130°C. A further 26 parts of water are now removed azeotropically by additional treatment at 130°C, whereupon the condensation product forms a very highly viscous mass. This is cooled to 90°C, the product is dissolved by adding 200 parts of water and the xylene is largely stripped off. The aqueous solution is completely evaporated in vacuo at 70°C. 160 parts of a very highly viscous yellowish condensation product are obtained, the product being diluted with water to 80% active substance content to facilitate handling.

44. 244 parts of a 78 percent strength aqueous solution of THPC (1 mol) and 51.5 parts (0.5 mol) of biuret are treated for 2 hours at 100°C internal temperature in a stirred vessel of 500 parts by volume capacity which is equipped with a thermometer and reflux condenser. The mixture is then cooled to room temperature and 291 parts of a yellow product of low viscosity are obtained. The active substance content is 76 percent.

45. 244 parts (1 mol) of a 78 percent strength aqueous THPC solution and 90.5 parts (0.25 mol) of a 45 percent strength aqueous solution of the dimethylol compound of biuret are condensed for 2 hours at 100°–105°C in a stirred vessel of 500 parts by volume capacity which is equipped with a reflux condenser and thermometer. After cooling, a yellowish solution, of low viscosity, of the condensation product is obtained, analysis of which shows a phosphorus content of 9.65 percent.

46. 244 parts (1 mol) of a 78 percent strength aqueous solution of THPC and 26.5 parts (0.25 mol) of the monomethylol compound of thiourea are condensed for 2 hours at 100°–105°C in a stirred vessel of 500 parts by volume capacity which is equipped with a reflux condenser and thermometer. After cooling, 267 parts of a colourless solution, of low viscosity, of the condensation product is obtained, analysis of which shows a phosphorus content of 11.6 percent.

47. 244 parts of a 78 percent strength aqueous solution of tetrakishydroxymethylphosphonium chloride (1 mol) and 11.9 parts of guanidiine hydrochloride (0.125 mol) are treated for 2 hours at about 110°C internal temperature in a stirred vessel of 500 parts by volume capacity which is equipped with a thermometer and reflux condenser. After completion of the reaction, the mixture is cooled to room temperature and a yellowish solution, of low viscosity, of the condensation product, containing 77 percent of active substance, is obtained.

48. 244 parts of a 78 percent strength aqueous solution of THPC (1 mol of THPC) and 40 parts of guanylurea phosphate (0.1 mol) are treated for 2 hours at 100°C internal temperature in a stirred vessel of 500 parts by volume capacity which is equipped with a thermometer and reflux condenser. The mixture is then cooled to room temperature and 283 parts of a clear, yellowish solution which contains 79 percent of active substance are obtained.

49. 244 parts of an aqueous 78 percent strength THPC solution (1 mol) and 106 parts (0.175 mol) of an aqueous 39.5 percent strength solution of the dimethylol compound of guanidine carbonate (prepared from 1 mol of guanidine carbonate + 2 mols of $CH_2O$) are mixed at room temperature in a stirred vessel of 500 parts by volume capacity, equipped with a thermometer and reflux condenser, during which mixing a vigorous evolution of $CO_2$ occurs. When this evolution of $CO_2$ has subsided, the condensation is carried out for 2 hours at 100° – 105°C internal temperature.

After cooling, 345 parts of a clear aqueous solution of the condensation product, containing 9 percent of phosphorus, are obtained.

50. 244 parts of a 78 percent strength aqueous solution of THPC (1 mol) and 203 parts (0.5 mol) of a 40 percent strength aqueous solution of a compound of the formula (101)

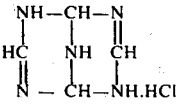

are treated for 2 hours at 100°C internal temperature in a stirred vessel of 500 parts by volume capacity which is equipped with a thermometer and reflux condenser. The solution is then concentrated in vacuo at 60°C to 80 percent active substance content.

307 parts of a solution of low viscosity are obtained. The active substance content is 81.5 percent.

51. 244 parts (1 mol) of a 78 percent strength aqueous THPC solution and 145 parts (0.5 mol) of a 60 percent strength aqueous solution of a compound of the formula (102)

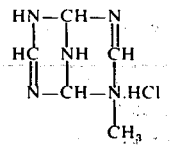

are condensed for 2 hours at 100° – 105°C in a stirred vessel of 500 parts by volume capacity which is equipped with a reflux condenser and thermometer. After cooling, 388 parts of a yellowish-coloured aqueous solution of the condensation product are obtained. The phosphorus content of this solution is 8 percent.

52. 244 parts of a 78 percent strength aqueous THPC solution (1 mol), 22 parts of oxalic acid diamide (0.25 mol) and 200 parts of a xylene isomer mixture are heated to the boil, with rapid stirring, in a stirred vessel of 500 parts by volume capacity which is equipped with a water separator and thermometer. The azeotropic removal of the water from the aqueous THPC solution commences at a boiling point of 103°C. After the removal of this water (53.5 parts) the boiling point of the xylene is 130°C. A further 23.5 parts of water are now removed azeotropically by additional treatment at this temperature, after which the condensation product forms a very highly viscous mass. It is cooled to 95°C, the product is dissolved by adding 200 parts of water and the xylene is largely stripped off. The aqueous solution is evaporated in vacuo at 70°C. 175 parts of a yellow highly viscous product are obtained. The active substance content is 100 percent.

53. 244 parts of a 78 percent strength aqueous solution of THPC (1 mol of THPC) and 52.5 parts of hydroxyethyl carbamate (0.5 mol) are treated for 2 hours at 100°C internal temperature in a stirred vessel of 500 parts by volume capacity which is equipped with a thermometer and reflux condenser. The mixture is then cooled to room temperature and then 296 parts of a clear, light yellowcoloured solution which contains 83 percent of active substance are obtained.

54. 244 parts of a 78 percent strength aqueous solution of THPC (1 mol of THPC) and 117 parts of a 57.7 percent strength aqueous solution of N-dimethylolmethyl carbamate (0.5 mol) are treated for 2 hours at 100°C internal temperature in a stirred vessel of 500 parts by volume capacity which is equipped with a thermometer and reflux condenser. The solution is then concentrated in vacuo at about 60°C.

246 parts of a colourless product of low viscosity which contains 97.5 percent of active substance are obtained.

55. 244 parts of a 78 percent strength aqueous THPC solution (1 mol) are cooled to 10°C in a stirred vessel of 500 parts by volume capacity which is equipped with a reflux condenser and thermometer, and are neutralized to pH 7.2 by slow addition of 46.6 parts of 30 percent strength aqueous sodium hydroxide solution, whilst stirring rapidly. Thereafter, 75 parts (1 mol) of methyl carbamate are added and the mixture is condensed for 2 hours at 100° – 105°C. After cooling, 361 parts of a yellowish solution, of low viscosity, of the condensation product are obtained. The phosphorus content of the solution is 8,6 percent.

56. 10 parts of 37 percent strength aqueous hydrochloric acid are added to 244 parts of a 78% strength aqueous solution of THPC (1 mol) and 23 parts (0.1 mol) of $\beta,\beta',\beta''$-nitrilo-tris-propionic acid amide in a stirred vessel of 500 parts by volume capacity which is equipped with a reflux condenser and thermometer and the condensation is carried out for 2 hours at 100° – 110°C internal temperature. After cooling, 275 parts of a yellowish solution, of low viscosity, of the condensation product are obtained. The phosphorus content of this solution is 11.3 percent.

57. 244 parts of a 78 percent strength aqueous THPC solution (1 mol), 12.6 parts of melamine (0.1 mol) and 200 parts of a xylene isomer mixture are heated to the boil, with rapid stirring, in a stirred vessel of 500 parts by volume capacity which is equipped with a water separator and thermometer. The azeotropic removal of the water from the aqueous THPC solution commences at a boiling point of 103°C. After removal of this water (53.5 parts) the boiling point of the xylene is 130°C. A further 9.5 parts of water are removed azeotropically by additional treatment at this temperature, after which the condensation product forms a highly viscous mass. It is cooled to 95°C, the product is dissolved by adding 200 parts of water and the xylene is largely stripped off. The aqueous solution is evaporated in vacuo at 60°C.

185 parts of a very highly viscous product which has an active substance content of 100 percent, are obtained.

58. 97.6 parts of a 78 percent strength aqueous solution of THPC (0.4 mol) and 11 parts (0.04 mol) of a compound of the formula (103)

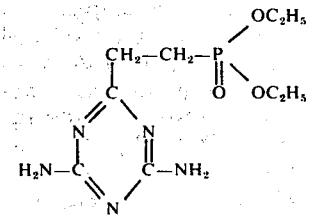

are treated for 2 hours at 100° to 110°C internal temperature in a stirred vessel of 200 parts by volume capacity which is equipped with a thermometer and reflux condenser. The mixture is then cooled to room temperature. 107.5 parts of a rose-coloured solution of low viscosity, which contains 80 percent of active substance, are obtained.

59. 190.5 parts of crystalline anhydrous THPC (1 mol) and 2.52 parts of melamine (0.02 mol) are condensed for 2 hours in the melt at 105°– 120°C in a stirred vessel of 500 parts by volume capacity which is equipped with a reflux condenser and thermometer. The mixture is then cooled to 50°C, 80 parts of methanol and 0.1 part of 37 percent strength aqueous HCl are added and etherification is carried out for 30 minutes at the reflux temperature (approx. 65°C). The excess methanol is then removed in vacuo. 174 parts of a reddish-coloured crystalline product are obtained.

The phosphorus content is 17.8 percent.

60. 244 parts of a 78 percent strength aqueous THPC solution (1 mol), 12.5 parts of acetoguanamine (0.1 mol) and 17 parts of a 35.4 percent strength aqueous formaldehyde solution (0.2 mol) are condensed for 2 hours at 100°– 110°C in a stirred vessel of 500 parts by volume capacity which is equipped with a reflux condenser and thermometer. After cooling, 268 parts of a reddish-coloured solution, of low viscosity, of the condensation product are obtained. The phosphorus content is 11.6 percent.

61. 244 parts of a 78 percent strength aqueous THPC solution (1 mol) are cooled to 10°C internal temperature in a stirred vessel of 500 parts by volume capacity which is equipped with a reflux condenser and thermometer, and are neutralised to pH 7.2 by slow addition of 54.6 parts of 30 percent strength aqueous NaOH whilst stirring rapidly. 21.6 parts (0.1 mol) of trimethylolmelamine are then added and the condensation is carried out for 2 hours at 100°– 105°C. After cooling, 317 parts of a colourless solution, of low viscosity, of the condensation product are obtained. The phosphorus content is 9.8 percent.

62. 244 parts of a 78 percent strength aqueous solution of THPC (1 mol) and 4.9 parts of triglycidylisocyanurate (0.02 mol) in 200 parts of toluene are heated, with rapid stirring, in a stirred vessel of 500 parts by volume capacity which is equipped with a reflux condenser, water separator and thermometer. The azeotropic removal of the water from the aqueous THPC solution, and of the water formed by condensation (a total of 54 parts of water) commences at a boiling point of 92°C. After removal of this amount of water, the boiling point rises to 108°C without further water being formed. The mixture is cooled to approx. 40°C, the toluene is siphoned off as far as possible and the condensation product is dissolved in 80 parts of methanol. After addition of 0.15 part of 37 percent strength aqueous hydrochloric acid, the etherification is carried out for 30 minutes at the boiling point of methanol (65°C). Finally, the excess methanol is removed in vacuo at 60°C. 190 parts of a white crystalline product are obtained. The phosphorus content is 16.3 percent.

63. 196 parts of a 78 percent strength aqueous THPC solution (0.8 mol), 40 parts of triglycidylisocyanurate (0.16 mol) and 200 parts of a xylene isomer mixture are heated to the boil, while stirring rapidly, in a stirred vessel of 500 parts by volume capacity which is equipped with a water separator and thermometer. The azeotropic removal of the water from the aqueous THPC solution commences at a boiling point of 101°C. After removal of this water (about 43 parts) the boiling point of the xylene is 130° to 133°C. A further 15 parts of water are now removed azeotropically by additional treatment at this temperature, after which the condensation product forms a highly viscous mass. It is cooled to 95°C, the product is dissolved by adding 200 parts of water and the xylene is largely stripped off. The aqueous solution is completely evaporated in vacuo at 70°C. 162 parts of a yellow product of high viscosity are obtained. The active substance content is 100 percent.

EXAMPLE 1

Mixed fabrics of polyester-cotton (PES/CO) (50:50 and 67:33) are padded with the liquors according to Tables 1 and 2 below, dried for 30 minutes at about 80°C and then cured for 5 minutes at 150°C.

The fabric is then rinsed for 5 minutes at 60°C in a liquor which contains, per liter, 5 ml of hydrogen peroxide (35 percent), 3 g of aqueous sodium hydroxide solution (30 percent) and 1 g of a 25 percent strength aqueous solution of a condensation product of 1 mol of p-tert. nonylphenol and 9 mols of ethylene oxide. The fabric is then rinsed and dried. The degree of fixing indicates the amount of product present on the fibre material after rinsing (relative to the amount originally absorbed).

The fabrics are then washed up to 40 times for 45 minutes at 60°C in a domestic washing machine, in a liquor which contains 4 g/l of a household detergent (SNV 198,861 wash). The individual fabric samples are then tested for their flame resistance (DIN 53,906 vertical test; ignition time 6 seconds).

The handle of the individual fabric samples is assessed after the rinse, in accordance with the following scale:

0: Unchanged compared to untreated fabric
1: Slightly stiffer than 0
2: Somewhat stiffer than 0
3: Stiff
4: Very stiff.

The results are summarised in Tables 1 and 2 which follow.

A check of the manual assessment of the handle, by means of the flexural stiffness test according to ASTM D 1388 - 64T confirms the handle ratings found, in that the ASTM values are all approximately between $1.0 \times 10^3$ and $2.1 \times 10^3$ mg.cm whilst fabrics which have been finished without conjoint use of an agent for imparting a soft handle show ASTM values of $2.8 \times 10^3$ to $8.2 \times 10^3$ mg.cm. The term "softeners" is to be understood, in the present and subsequent examples, to mean agents for imparting a soft handle.

Table 1

| Constituents g/l | Untreated | Fabric treated with liquor PES/CO 67:33 A | B | C | D | E | PES/CO 50:50 A | B | C | D | E |
|---|---|---|---|---|---|---|---|---|---|---|---|
| Product according to Instrunction 1 (71% strength) | | 580 | 580 | 580 | 580 | 580 | 580 | 580 | 580 | 580 | 580 |
| Softener of the formula | | | | | | | | | | | |
| 7.1 | | 30 | | | | | 30 | | | | |
| 7.2 | | | 30 | | | | | 30 | | | |
| 7.3 20% strength | | | | 30 | | | | | 30 | | |
| 8.1 | | | | | 30 | | | | | 30 | |
| 8.2 | | | | | | 30 | | | | | 30 |
| Di-trimethylolmelamine | | 103 | 103 | 103 | 103 | 103 | 103 | 103 | 103 | 103 | 103 |
| Liquor uptake, % | | 70 | 70 | 70 | 70 | 70 | 70 | 70 | 70 | 70 | 70 |
| Degree of fixing, % | | 76 | 78 | 77 | 76 | 77 | 72 | 74 | 75 | 81 | 77 |
| Flame resistance: | | Burning time (seconds)/tear length (cm) | | | | | | | | | |
| After rinsing | Burns | 0/12 | 0/11 | 0/11 | 0/10.5 | 0/12 | 0/8 | 0/9 | 0/8 | 0/8 | 0/8.5 |

Table 1-continued

| Constituents g/l | Un-trea-ted | Fabric treated with liquor PES/CO 67:33 A | B | C | D | E | PES/CO 50:50 A | B | C | D | E |
|---|---|---|---|---|---|---|---|---|---|---|---|
| After 20 washes | Burns | 1/9.5 | 0/9 | 1/10.5 | 0/8.5 | 0/8.5 | 0/8 | 0/8 | 0/9.5 | 0/8.5 | 0/7.5 |
| After 40 washes | Burns | 0/9 | 0/7.5 | 2/9 | 0/9 | 3/9 | 0/8.5 | 0/7.5 | 0/8 | 0/7.5 | 0/8.5 |
| Handle | 0 | 2¼ | 2 | 1¾ | 2½ | 2½ | 1½ | 1¾ | 1¾ | 2½ | 2¼ |
| Handle without added softener | 0 | | | 3½ | | | | | 4 | | |

Table 2

| Constituents g/l | Un-trea-ted | Fabric treated with liquor PES/CO 67:33 F | G | H | I | PES/CO 50:50 F | G | H | I |
|---|---|---|---|---|---|---|---|---|---|
| Product according to Instruction 24 (68% strength) | | 860 | 860 | 860 | 860 | 860 | 860 | 860 | 860 |
| Softener of the formula | | | | | | | | | |
| 7.1 | | 30 | | | | 30 | | | |
| 7.2 20% strength | | | 30 | | | | 30 | | |
| 8.1 | | | | 30 | | | | 30 | |
| 8.2 | | | | | 30 | | | | 30 |
| Di-trimethylolmelamine | | 86 | 86 | 86 | 86 | 86 | 86 | 86 | 86 |
| Liquor uptake, % | | 70 | 70 | 70 | 70 | 70 | 70 | 70 | 70 |
| Degree of fixing, % | | 71 | 71 | 73 | 71 | 69 | 72 | 72 | 70 |
| Flame resistance: | | Burning time (seconds)/tear length (cm) | | | | | | | |
| After rinsing | Burns | 1/11.5 | 0/10 | 0/10.5 | 2/12.5 | 0/9.5 | 0/8.6 | 0/10.5 | 0/9.5 |
| After 20 washes | Burns | 0/9.5 | 0/10.5 | 0/11.5 | 0/10.5 | 0/10 | 0/8 | 0/8.5 | 0/9.5 |
| After 40 washes | Burns | 0/10.5 | 1/11 | 0/9 | 0/11 | 0/8 | 0/9.5 | 0/9.5 | 0/8.5 |
| Handle | 0 | 2½ | 2¼ | 2¾ | 2¾ | 2½ | 2¾ | 2½ | 2½ |
| Handle without added softener | 0 | | | 4 | | | | 4 | |

EXAMPLE 2

In the same way as that indicated in Example 1, mixed fabrics of polyester-cotton, 50:50 and 67:33, are finished with a liquor according to Tables 3 and 4 which follow, rinsed, washed up to 40 or 86 times, and tested.

The results are summarised in Tables 3 and 4 which follow.

Table 3

| Constituents g/l | Un-trea-ted | Fabric Treated with liquor PES/CO 67:33 A | B | C | D | PES/CO 50:50 E | F | G* | PES/CO 67:33 H | I | J |
|---|---|---|---|---|---|---|---|---|---|---|---|
| THPC (78% strength | | 545 | 545 | 545 | 545 | 545 | 545 | [1]545 | 545 | 545 | 545 |
| Dimethylolurea | | 80.5 | — | — | — | — | — | [4]80.5 | 80.5 | — | — |
| Di-trimethylolmelamine | | 80 | 80 | 125 | 80 | 80 | 125 | [3]80 | 80 | 80 | 125 |
| Allylamine | | 25.9 | 25.9 | 25.9 | 25.9 | 25.9 | 25.9 | [2]25.9 | 25.9 | 25.9 | 25.9 |
| Dimethylolurea-dimethyl ether | | — | 154 | — | — | 154 | — | — | — | 154 | — |
| Softener of the formula 7.1 (17% strength) | | 35 | 35 | 35 | 35 | 35 | 35 | [5]+ | — | — | 30 |
| Softener of the formula 8.7 (20% strength) | | — | — | — | — | — | — | — | 30 | 30 | — |
| pH value of the liquor | | 4.6 | 4.4 | 4.6 | 4.6 | 4.4 | 4.6 | 4.2 | 4.7 | 4.6 | 4.9 |
| Liquor uptake, % | | 75 | 75 | 75 | 75 | 75 | 75 | 75 | 75 | 75 | 75 |
| Degree of fixing, % | | 72 | 78 | 81 | 60 | 77 | 77 | 76 | 67 | 67 | 71 |
| Flame resistance: Burning time (seconds) / tear length (cm) | | | | | | | | | | | |
| After rinsing | Burns | 0/10.5 | 0/11.5 | 0/11 | 0/12.5 | 0/9 | 0/10 | 0/10 | 0/10 | 1/12 | 0/12 |
| After 20 washes | Burns | 0/10.5 | 0/10 | 0/10.5 | 0/9.5 | 0/8 | 0/9.5 | 0/10.5 | — | — | — |
| After 40 washes | Burns | 0/10 | 0/11 | 0/11.5 | 0/10.5 | 0/10.5 | 0/10 | 0/10 | 1/13 | 0/12 | 0/12 |
| Handle | 0 | 2¼ | 2 | 2¼ | 1½ | 1½ | 2½ | 1½ | 2½ | 2½ | 2½ |
| Handle without added softener | 0 | 4 | 4 | 3¾ | 3¾ | 3¾ | 3¾ | 3¾ | 4 | 4 | 2¾ |

*The components were added to the liquor in accordance with the numbering. In liquors A to F and H to J all components were added simultaneously.

Table 4

| Constituents g/l | Un-trea-ted | Fabrics treated with liquor PES/CO 67:33 K | L | PES/CO 50:50 M | N |
|---|---|---|---|---|---|
| THPC (78% strength) | | 545 | 545 | 545 | 545 |
| Dimethylolurea | | — | 80.5 | — | — |
| Di-trimethylolmelamine | | 80 | 80 | 80 | 103 |
| Urea | | 40.4 | — | 40.3 | — |
| Allylamine | | 25.9 | 25.9 | 25.9 | 25.9 |
| Softener of the formula 7.1 (17% strength) | | 30 | 35 | 30 | 35 |
| pH value of the liquor | | 4.4 | 4.6 | 4.4 | 4.6 |
| Liquor uptake, % | | 75 | 75 | 75 | 75 |

Table 4-continued

| Constituents g/l:50 | Untreated | Fabrics treated with liquor PES/CO 67:33 K | L | M | N | PE-/CO |
|---|---|---|---|---|---|---|
| Degree of fixing, % | | 75 | 74 | 70 | 67 | |
| Flame resistance: Burning time (seconds) / tear length (cm) | | | | | | |
| After rinsing | Burns | 0/11.5 | 0/12 | 0/9.5 | 0/12 | |
| After 40 washes | Burns | 0/11 | 0/9.5 | 0/9 | 0/10 | |
| After 86 washes | Burns | 0/12 | 0/9.5 | 0/10 | 0/12 | |
| Handle | 0 | 2½ | 2 | 2 | 2 | |
| Handle without added softener | 0 | 3¾ | | 3¾ | | |

EXAMPLE 3

Mixed fabrics of polyester-cotton (PES/CO) 67:33 and 50:50, are padded with the following liquors: 545 g/l of THPC (78 percent strength), 80.5 g/l of dimethylolurea, 80 g/l of di-trimethylolmelamine, 35 g/l of softener, X g/l of amine; liquor uptake 75 percent.

After padding, the fixing, rinsing, washing (up to 40 or 86 times) and testing is carried out as indicated in Example 1.

The results are summarised in Tables 5 and 6 which follow.

Table 5

| Amine, g/l* | Untreated | Fabrics treated with liquor PES/CO 67:33 A | B | C | D | E | F | G | H | PES/CO 50:50 I | J | K | PES/CO 67:33 L |
|---|---|---|---|---|---|---|---|---|---|---|---|---|---|
| Allylamine hydrochloride | | — | — | — | — | 42.5 | — | — | — | 42.5 | — | — | — |
| Allylamine | | 25.9 | — | — | — | — | — | — | — | — | — | — | — |
| 2-Amino-2-methylpropanol | | — | — | — | — | — | — | 41.5 | — | — | — | 41.5 | — |
| Propylamine | | — | 26.8 | — | — | — | — | — | — | — | — | — | — |
| Pyrrolidine | | — | — | 32.3 | — | — | — | — | — | — | — | — | — |
| Piperidine | | — | — | — | 38.8 | — | — | — | — | — | — | — | 38.8 |
| Piperidine hydrochloride | | — | — | — | — | — | 55.5 | — | — | — | 55.5 | — | — |
| Softener of the formula 7.1 (17% strength) | | 35 | 35 | 35 | 35 | 35 | 35 | 35 | 35 | 35 | 35 | 35 | — |
| Softener of the formula 8.7 (20% strength | | — | — | — | — | — | — | — | — | — | — | — | 30 |
| pH value of the liquor | | 4.6 | 4.6 | 5.2 | 5.3 | 2.9 | 3.9 | 5.1 | 4.4 | 2.9 | 3.9 | 5.1 | 5.1 |
| Degree of fixing, % | | 72 | 73 | 74 | 65 | 59 | 68 | 64 | 70 | 68 | 60 | 55 | 63 |
| Flame resistance: Burning time (seconds) / tear length (cm) | | | | | | | | | | | | | |
| After rinsing | Burns | 0/10.5 | 0/12 | 0/10.5 | 3/10.5 | 0/11 | 0/11.5 | 0/9.5 | 0/9.5 | 0/10 | 0/10.5 | 0/8 | 0/11.5 |
| After 20 washes | Burns | 0/10.5 | 0/9 | 0/10 | 1.5/13 | — | — | — | 0/8 | — | — | — | — |
| After 40 washes | Burns | 0/10 | 0/11.5 | 0/11 | 0/13 | 0/10.5 | 0/10 | 0/9.5 | 0/8 | 0/10 | 0/7.5 | 0/7.5 | 0/11 |
| Handle | 0 | 2¼ | 1½ | 1¾ | 1¼ | 2 | 2½ | 2¼ | 1½ | 2 | 2 | 2½ | 2½ |
| Handle without added softener | 0 | | | | 4 | | | | | | 3¾ | | 4 |

*=Equimolar amounts

Table 6

| Amine g/l* | Untreated | Fabrics treated with liquor 67:33 PES/CO 50:50 M | N | O | P | Q | R | S | T | U |
|---|---|---|---|---|---|---|---|---|---|---|
| Allylamine | | — | 25.9 | — | — | — | — | — | — | — |
| 1,2,5,6-Tetrahydropyridine | | — | — | 37.8 | — | — | — | — | — | — |
| Propylamine | | — | — | — | 26.8 | — | — | — | — | — |
| Pyrrolidine | | — | — | — | — | 32.3 | — | — | — | — |
| Piperidine | | — | — | — | — | — | 38.8 | — | — | — |
| Ethanolamine | | — | — | — | — | — | — | 27.7 | — | — |
| Diethanolamine | | 47.5 | — | — | — | — | — | — | 47.5 | — |
| Triethanolamine | | — | — | — | — | — | — | — | — | 67.5 |
| pH value of the liquor | | 5.2 | 4.6 | 5.3 | 4.6 | 5.2 | 5.3 | 4.4 | 5.2 | 5.8 |
| Degree of fixing | | 76 | 74 | 72 | 73 | 77 | 76 | 74 | 72 | 69 |
| Flame resistance: Burning time (seconds) / tear length (cm) | | | | | | | | | | |
| After rinsing | Burns | 5/12.5 | 0/12 | 0/9 | 0/11.5 | 0/9.5 | 0/9.5 | 0/10 | 0/9.5 | 0/10 |
| After 40 washes | Burns | 0/12.5 | 0/9.5 | 0/8.5 | 2/11 | 0/8.5 | 0/9 | 0/9 | 0/8.5 | 0/9 |
| After 86 washes | Burns | 0/12 | 0/9.5 | 0/10 | 0/12 | 0/10 | 0/10.5 | 0/10 | 0/11 | 0/10 |
| Handle | 0 | 2½ | 2 | 1½ | 2 | 1½ | 1/½ | 2 | 2 | 1½ |
| Handle without amine and without added softener | 0 | 3¾ | | | | | 3¾ | | | |

*= Equimolar amounts

EXAMPLE 4

In the same way as that described in Example 1, a mixed fabric of polyester-cotton, 67:33 and 50:50, is finished with a liquor according to Table 7 which follows, rinsed, washed up to 40 times and tested.

The results are summarised in Table 7 which follows.

Table 7

| Constituents 1 g/l | Untreated | A 67:33 | B 50:50 | C 67:33 | 50:50 | 67:33 | 50:50 |
|---|---|---|---|---|---|---|---|
| | | Fabrics treated with liquor | | | | | |
| THPC (78% strength) | | | 545 | | — | | — |
| Product according to Instruction | | | | | | | |
| 1 (71% strength) | | | — | | 575 | | — |
| 24 (74.4% strength) | | | — | | — | | 775 |
| Dimethylolurea | | | 80.5 | | — | | — |
| Di-trimethylolmelamine | | | 80 | | 103 | | 86 |
| Softener of the formula 7.1 (17% strength) | | | 35 | | 35 | | 35 |
| Piperidine | | | 38.8 | | — | | — |
| pH value of the liquor | | 5.3 | 5.3 | 5.6 | 5.6 | 5.5 | 5.5 |
| Liquor uptake, % | | 70 | 70 | 70 | 70 | 70 | 70 |
| Degree of fixing, % | | 65 | 76 | 73 | 71 | 70 | 76 |
| Flame resistance: Burning time (seconds) / tear length (cm) | | | | | | | |
| After rinsing | Burns | 0/10.5 | 0/9.5 | 0/9.5 | 0/8.5 | 0/9.5 | 0/9.5 |
| After 20 washes | Burns | 3/13 | 0/7.5 | 2/9 | 0/8 | 1/10.5 | 0/8 |
| After 40 washes | Burns | 1.5/13 | 1/9 | 5/8 | 0/8.5 | 0/12 | 0/7 |
| Handle | 0 | 1¼ | 1½ | 2¼ | 2 | 2¼ | 2¼ |

Similar results are also obtained when using the products according to Instructions 2 to 23 and 25 to 26 as component (1).

EXAMPLE 5

Mixed fabrics of polyester-cotton 50:50, are padded with the following liquors: 545 g/l of THPC (78% strength), 39 g/l of piperidine, 80 g/l of ditrimethylolmelamine, 35 g/l of softener of the formula 7.1 (17% strength) and X g/l of component (4).

After padding, the fixing, rinsing, washing - up to 40 times - and testing are carried out as indicated in Example 1.

The results are summarised in Table 8 which follows.

Table 8

| Component (4), g/l | Untreated | A | B | C | D | E |
|---|---|---|---|---|---|---|
| | | Fabric treated with liquor | | | | |
| Dimethylolurea | | 80.5 | 161 | — | — | — |
| Cyanamide (98% strength) | | — | — | 28.9 | — | — |
| Biuret (95% strength) | | — | — | — | 73 | — |
| Dicyandiamide (100% strength) | | — | — | — | — | 30 |
| pH value of the liquor | | 5 | 5.2 | 4.7 | 5.1 | 5.1 |
| Liquor uptake, % | | 75 | 75 | 75 | 75 | 75 |
| Degree of fixing, % | | 66 | 70 | 63 | 53 | 54 |
| Flame resistance: Burning time (seconds) / tear length (cm) | | | | | | |
| After rinsing | burns | 0/10 | 0/7.5 | 0/8 | 0/9 | 0/11.5 |
| After 40 washes | burns | 0/7 | 0.7.5 | 0/9 | 0/8 | 5/14 |
| Handle | 0 | 1¾ | 2¾ | 1½ | 1¾ | 1½ |

EXAMPLE 6

Mixed fabrics of polyester-cotton 67:33 and 50:50, are finished with the following liquors as indicated in Example 1, rinsed, washed up to 60 times and tested:

| | |
|---|---|
| a) Product according to Instruction 1 (76% strength): | 535 g/l |
| Di-trimethylolmelamine | 103 g/l |
| Softener (100% strength) | 6 g/l |
| b) Product according to Instruction 24 (80% strength): | 660 g/l |
| Di-trimethylolmelamine | 86 g/l |
| Softener (100% strength) | 6 g/l |
| c) THPC (78% strength) | 585 g/l |
| Piperidine | 42 g/l |
| Di-trimethylolmelamine | 134 g/l |
| Softener (100% strength) | 6 g/l |
| liquor uptake, 70% | |

The results are summarised in Tables 9 to 13 which follow.

Table 9

| | Untreated | $a_1$ | $a_2$ | $a_3$ | $a_4$ | $a_5$ | $a_6$ | $a_7$ |
|---|---|---|---|---|---|---|---|---|
| | | PES/CO 67:33, treated with liquors a) | | | | | | |
| Softener of the formula | | 7.1 | 7.6 | 7.7 | 7.17 | 7.18 | 8.1 | 8.2 |
| Degree of fixing, % | | 75 | 72 | 75 | 69 | 70 | 73 | 65 |
| Flame resistance: Burning time (seconds) / tear length (cm) | | | | | | | | |
| After rinsing | Burns | 0/10 | 0/7 | 0/9 | 0/7 | 0/5 | 0/8 | 0/9 |
| After 30 washes | Burns | 0/9.5 | 0/7 | 0/7 | 0/7.5 | 0/6 | 0/10.5 | 0/9 |
| After 60 washes | Burns | 0/7.5 | 0/11.5 | 0/8 | 0/7.5 | 0/9 | 0/8 | 0/8 |
| Handle | 0 | 2¼ | 1½ | 2 | 2¼ | 1¾ | 2½ | 2½ |
| Handle without added softener | 0 | | | | 3¾ | | | |

Table 10

| | Untreated | PES/CO 50:50, treated with liquors a) | | | | | | | | | | |
|---|---|---|---|---|---|---|---|---|---|---|---|---|
| | | $a_8$ | $a_9$ | $a_{10}$ | $a_{11}$ | $a_{12}$ | $a_{13}$ | $a_{14}$ | $a_{15}$ | $a_{16}$ | $a_{17}$ | $a_{18}$ |
| Softener of the formula | | 7.1 | 7.5 | 7.6 | 7.7 | 7.11 | 7.12 | 7.13 | 7.17 | 7.18 | 8.2 | 8.3 |
| Degree of fixing, % | | 80 | 70 | 73 | 76 | 72 | 72 | 69 | 70 | 69 | 69 | 69 |
| Flame resistance: Burning time (seconds) / tear length (cm) | | | | | | | | | | | | |
| After rinsing | Burns | 0/6 | 0/6 | 0/5 | 0/6 | 0/5 | 0/6 | 0/7 | 0/6 | 0/4 | 0/6 | 0/6 |
| After 30 washes | Burns | 0/7 | 0/8 | 0/8 | 0/6 | 0/5.5 | 0/8.5 | 0/7.5 | 0/6.5 | 0/8.5 | 0/7.5 | 0/7.5 |
| After 60 washes | Burns | 0/6 | 0/8 | 0/11.5 | 0/7.5 | 0/10 | 0/7.5 | 0/7 | 0/8.5 | 0/8 | 0/8 | 0/10.5 |
| Handle | 0 | 2¼ | 2¾ | 1½ | 2 | 2¼ | 2¼ | 2¼ | 2½ | 1½ | 2 | 1¾ |
| Handle without added softener | 0 | | | | | | 4 | | | | | |

Table 11

| | Untreated | PES/CO, treated with liquors b) | | | | | | | | |
|---|---|---|---|---|---|---|---|---|---|---|
| | | 67:33 | | | | | 50:50 | | | |
| | | $b_1$ | $b_2$ | $b_3$ | $b_4$ | $b_5$ | $b_6$ | $b_7$ | $b_8$ | $b_9$ |
| Softener of the formula | | 7.1 | 7.6 | 7.18 | 8.2 | 7.1 | 7.6 | 7.18 | 8.2 | 8.3 |
| Degree of fixing, % | | 76 | 68 | 74 | 72 | 69 | 68 | 73 | 68 | 71 |
| Flame resistance: Burning time (seconds) / tear length (cm) | | | | | | | | | | |
| After rinsing | Burns | 0/11 | 0/6 | 0/6 | 0/9 | 0/5 | 0/8 | 0/7 | 0/6 | 0/8 |
| After 30 washes | Burns | 1/10.5 | 0/9 | 0/8.5 | 0/7.5 | 0/7 | 0/7.5 | 0/7.5 | 0/8 | 0/8.5 |
| After 60 washes | Burns | 0/9.5 | 0/8 | 0/8 | 0/7.5 | 0/8.5 | 0/8 | 0/9.5 | 0/7.5 | 0/7 |
| Handle | 0 | 2½ | 1¾ | 2½ | 2½ | 2¾ | 2 | 2¾ | 2/½ | 2¼ |
| Handle without added softener | 0 | | | 4 | | | | 4 | | |

Table 12

| | UNtreated | PES/CO 67:33, treated with liquors c) | | | | | | | | | | | |
|---|---|---|---|---|---|---|---|---|---|---|---|---|---|
| | | $c_1$ | $c_2$ | $c_3$ | $c_4$ | $c_5$ | $c_6$ | $c_7$ | $c_8$ | $c_9$ | $c_{10}$ | $c_{11}$ | $c_{12}$ |
| Softener of the formula | | 7.1 | 7.5 | 7.6 | 7.7 | 7.10 | 7.11 | 7.12 | 7.13 | 7.16 | 7.17 | 8.2 | 8.3 |
| Degree of fixing, % | | 77 | 70 | 70 | 66 | 67 | 65 | 63 | 67 | 65 | 68 | 66 | 64 |
| Flame resistance: Burning time (seconds) / tear length (cm) | | | | | | | | | | | | | |
| After rinsing | Burns | 0/9 | 0/5 | 0/7 | 0/8 | 0/9 | 0/9 | 0/9 | 0/8 | 0/8 | 0/10.5 | 0/9 | 0/8 |
| After 30 washes | Burns | 0/9 | 0/9.5 | 0/10.5 | 0/10 | 0/6 | 0/11 | 0/8.5 | 0/8.5 | 0/10 | 0/10.5 | 0/9 | 0/10.5 |
| After 60 washes | Burns | 0/9.5 | 0/10.5 | 0.11 | 0/8 | 0/7.5 | 0/8.5 | 0/9.5 | 0/9 | 0/11.5 | 0/8.5 | 0/10 | 0/8 |
| Handle | 0 | 2¼ | 2¼ | 1¾ | 2½ | 2¾ | 2¾ | 2¾ | 2¾ | 2½ | 2¼ | 2¼ | 2¾ |
| Handle without added softener | 0 | | | | | | | 3¾ | | | | | |

Table 13

| | Untreated | PES/CO 50:50, treated with liquors c) | | | | | | | | | | | | | | | |
|---|---|---|---|---|---|---|---|---|---|---|---|---|---|---|---|---|---|
| | | $c_{13}$ | $c_{14}$ | $c_{15}$ | $c_{16}$ | $c_{17}$ | $c_{18}$ | $c_{19}$ | $c_{20}$ | $c_{21}$ | $c_{22}$ | $c_{23}$ | $c_{24}$ | $c_{25}$ | $c_{26}$ | $c_{27}$ | $c_{28}$ |
| Softener of the formula | | 7.1 | 7.4 | 7.5 | 7.6 | 7.7 | 7.8 | 7.9 | 7.10 | 7.11 | 7.12 | 7.13 | 7.16 | 7.17 | 8.2 | 8.3 | 8.5 |
| Degree of fixing, % | | 79 | 64 | 70 | 70 | 72 | 70 | 71 | 67 | 71 | 62 | 72 | 69 | 74 | 61 | 63 | 62 |
| Flame resistance: Burning time (seconds) / tear length (cm) | | | | | | | | | | | | | | | | | |
| After rinsing | Burns | 0/5 | 0/7 | 0/8 | 0/6 | 0/9 | 0/6 | 0/8 | 0/8 | 0/7 | 0/9 | 0/9 | 0/8 | 0/8 | 0/6 | 0/5 | 0/7 |
| After 30 washes | Burns | 0/5.5 | 0/7.5 | 0/6.5 | 0/6.5 | 0/4.5 | 0/9 | 0/9.5 | 0/7.5 | 0/7.5 | 0/8 | 0/6.5 | 0/8.5 | 0/7 | 0/11.5 | 0/9 | 0/7 |
| After 60 washes | Burns | 9 | 0/7.5 | 0/8 | 0/7 | 0/9.5 | 0/10 | 0/9.5 | 0/8 | 0/7 | 0/8 | 0/8 | 0/6.5 | 0/10 | 0/7.5 | 0/9.5 | 0/8 |
| Handle | 0 | 2¾ | 2½ | 2 | 1¾ | 2½ | 2 | 2½ | ½ | 2½ | 2½ | 2½ | 2¼ | 2 | 2 | 2 | 2½ |
| Handle without added softener | 0 | | | | | | | | 3 | | | | | | | | |

EXAMPLE 7

Mixed fabrics of polyester/cotton, 67:33 and 50:50, are padded with the following liquors at a liquor uptake of 70 percent: 535 g/l of the product according to Instruction 1 (76 percent strength), 103 g/l of di-trimethylolmelamine and 6 g/l of agent for imparting a soft handle (100 percent strength).

1 part of the agent for imparting a soft handle is in each case first dissolved in 9 parts of isopropanol, with the addition of a few drops of glacial acetic acid, and boiling water is then added.

After padding, the fixing, rinsing, washing - up to 30 times - and testing is carried out as indicated in Example 1.

The results are summarised in Table 14 which follows.

Table 14

| | Untreated | PES/CO, fabric treated with liquor A 67:33 | A 50:50 | B 67:33 | B 50:50 | C 67:33 | C 50:50 | D 67:33 | D 50:50 |
|---|---|---|---|---|---|---|---|---|---|
| Softener of the formula | | 7.2 | | 7.9 | | 7.11 | | 7.12 | |
| Degree of fixing, % | | 79 | 81 | 79 | 80 | 74 | 79 | 76 | 81 |
| Flame resistance: Burning time (seconds) / tear length (cm) | | | | | | | | | |
| After rinsing | Burns | 2/9 | 0/8 | 2/9 | 0/6 | 2/8 | 0/5 | 3/8 | 0/8 |
| After 30 washes | Burns | 2/8.5 | 0/7 | 2/7.5 | 0/8 | 3/8.5 | 0/8.5 | 2/9 | 0/7 |
| Handle | 0 | 1¾ | 2 | 2½ | 2½ | 2¼ | 2¼ | 2½ | 2¼ |
| Handle without added softener | 0 | | | | | 4 | | | |

EXAMPLE 8

Mixed fabrics of polyester-cotton (65:35) are padded with the liquors from Table 15 which follows. The subsequent fixing, rinsing, washing - up to 60 times - and testing is carried out as indicated in Example 1.

The results are summarised in Table 15.

Table 15

| Treated with liquor | untreated | A | B | C | D | E | F | G |
|---|---|---|---|---|---|---|---|---|
| Constituents in g/l | | | | | | | | |
| Product according to Instruction 1 (76% strength) | | — | — | — | — | 695 | 630 | 695 |
| THPC (78% strength) | | 865 | 790 | 790 | 865 | — | — | — |
| Di-trimethylolmelamine | | 140 | 140 | 110 | 140 | 140 | 181 | 140 |
| Urea | | 70 | 70 | 70 | 55 | — | — | — |
| Agent for imparting a soft handle, of the formula (7.1) (17% strength) | | 40 | 40 | 40 | 40 | 40 | 40 | — |
| Agent for imparting a soft handle, of the formula (8.7) (20% strength) | | — | — | — | — | — | — | 40 |
| pH value of the bath | | 5.5 | 5.5 | 5.5 | 6 | 6 | 6 | 6.1 |
| Liquor uptake in % | | 80 | 80 | 80 | 80 | 80 | 80 | 80 |
| Degree of fixing in % | | 59 | 62 | 57 | 66 | 77 | 79 | 69 |
| Flame resistance | | | | | | | | |
| After rinsing | | | | | | | | |
| Burning time (seconds) | Burns | 0 | 0 | 0 | 0 | 0 | 0 | 1 |
| Tear length (cm) | | 12 | 11.5 | 11.5 | 10 | 11 | 12.5 | 11 |
| After 60 washes | | | | | | | | |
| Burning time (seconds) | Burns | 1 | 3 | 0 | 0 | 0 | 0 | 2 |
| Tear length (cm) | | 12 | 15 | 15 | 10.5 | 12 | 10.5 | 10.5 |
| Handle after rinsing | 0 | 2 | 2¼ | 2¾ | 1¾ | 2½ | 2½ | 2¾ |
| Handle without agent for imparting a soft handle | 0 | | | | 4 | | | |

EXAMPLE 9

Mixed fabrics of polyester-cotton (67:33) are padded with the liquors of Table 16 which follows, and are then fixed as indicated in Example 1, rinsed, washed up to 40 times and tested for their flame resistance and their handle.

In addition, the finished fabric samples are tested, before rinsing, for their stiffness in the weft direction according to ASTM Test D 1388/64T and for their abrasion resistance according to AATCC Test 93/1966.

The results are summarised in Table 16.

Table 16

| | Untreated fabric | Treated with liquor A | B | C | C | E |
|---|---|---|---|---|---|---|
| Constituents in g/l of liquor | | | | | | |
| Product according to Instruction 1 (76% strength) | | 730 | 730 | 730 | 730 | 730 |
| Agent for imparting a soft handle, of the formula (7.1) | | 50 | 50 | 50 | 50 | 50 |
| Dimethylolmelamine (100% strength) | | 120 | | | | |
| Trimethylolmelamine dimethyl ether (80% strength | | | 180 | | | |
| Trimethylolmelamine dimethyl ether (50% strength) | | | | 240 | | |
| Di-/tri-methylolmelamine-1/1-dimethyl ether (50% strength) | | | | | 240 | |
| Dimethylolmelamine dimethyl ether (50% strength) | | | | | | 240 |
| Liquor uptake in % | | 60 | 60 | 60 | 60 | 60 |
| Degree of fixing in % | | 66 | 62 | 62 | 60 | 62 |
| Flame-resistance | | | | | | |
| Before rinsing | | | | | | |
| Burning time (seconds) | Burns | 0 | 0 | 0 | 0 | 0 |
| Tear length (cm) | | 7.5 | 7 | 7 | 9 | 11 |
| After 40 washes | | | | | | |
| Burning time (seconds) | Burns | 6 | 4 | 0 | 6 | 4 |
| Tear length (cm) | | 10 | 11 | 11 | 13 | 12 |
| Handle (mg.cm) | 0 | 2¼ | 2 | 2 | 2 | 2 |
| Flexural stiffness | 470 | 485 | 400 | 310 | 310 | 358 |
| Abrasion loss (effective % by weight) after 3 minutes, 3,000 revolutions/minute | 2.5 | 12 | 13 | 11 | 12 | 14 |

EXAMPLE 10

Mixed fabrics of polyester-cotton, (67:33) and (50:50), are padded with the liquors shown in Table 17 which follows and subsequently fixed as indicated in Example 1, rinsed, washed up to 40 times and tested for their flame resistance and their handle. In addition, the flexural stiffness in the weft direction according to ASTM-Test D 1388/64 T and the abrasion resistance according to AATCC-Test 93/1966 of the finished fabric samples are investigated.

The results are summarised in Table 17.

EXAMPLE 11

Mixed fabrics of polyester-cotton (67:33) and (50:50), are padded with the liquors shown in Table 18 which follows and are then fixed as indicated in Example 1, rinsed, washed up to 40 times and tested for their flame resistance and their handle. In addition, the flexural stiffness and abrasion resistance are examined as indicated in Example 10.

The results are summarised in Table 18.

Table 17

| | PES/CO 50/50 Untreated | Fabric treated with liquor A | B | PES/CO 67/33 Untreated | Fabric treated with liquor C |
|---|---|---|---|---|---|
| Constituents in g/l of liquor | | | | | |
| Product according to Instruction 21 (77% strength) | | 745 | | | |
| Product according to Instruction 47 (77% strength) | | | | | 710 |
| Tetrakis-(hydroxymethyl)-phosphonium hydroxide (60% strength) | | | 710 | | |
| Urea | | | 50 | | |
| Agent for imparting a soft handle, of the formula (7.1) | | 17 | 17 | | 17 |
| Di-trimethylolmelamine | | 110 | 110 | | 110 |
| pH value of the bath | | 6 | 6 | | 6 |
| g of P per kg of fabric | | 60 | 60 | | 60 |
| g of N per kg of fabric | | 30 | 30 | | 30 |
| Liquor uptake in % | | 65 | 65 | | 65 |
| Degree of fixing in % | | 53 | 70 | | 56 |
| Flame resistance | | | | | |
| After rinsing, burning time (seconds) | Burns | 0 | 0 | Burns | 2 |
| Tear length (cm) | | 9.5 | 8 | | 13 |
| After 40 washes, burning time (seconds) | Burns | 2 | 0 | Burns | 5 |
| Tear length (cm) | | 11 | 10 | | 12.5 |
| Flexural stiffness (mg.cm) | 472 | 2,580 | 2,930 | 472 | 2,350 |
| Abrasion loss (scouring for 3 minutes at 3,000 revolutions/minute) (effective % by weight) | 2.4 | 8.8 | 7.6 | 2.4 | 13 |
| Handle without rinse | 0 | 2¼, 3¾ | 2¼ | 0 | 1½ |
| Handle without added agent for imparting a soft handle | 0 | | 3¾ | 0 | 4 |

Table 18

| | PES/CO 67/33 Treated with liquor A | B | C | D | E | F | G | H | I |
|---|---|---|---|---|---|---|---|---|---|
| Constituents in g/l of liquor | | | | | | | | | |
| THPC (76%) | | | 585 | | | | 585 | | |

Table 18-continued

| | | PES/CO 67/33 Treated with liquor | | | | | | | | |
|---|---|---|---|---|---|---|---|---|---|---|
| | | A | B | C | D | E | F | G | H | I |
| Product according to Instruction 1 (76%) | | 535 | | | 535 | 535 | | | 535 | |
| Product according to Instruction 24 (80%) | | | 660 | | | | 660 | | | 660 |
| Di-trimethylolmelamine | | 103 | 86 | | 103 | 103 | 86 | | 103 | 86 |
| Piperidine | | | | 42 | | | | 42 | | |
| Agent for imparting a soft handle, of the formula | | | | | | | | | | |
| | (7.1) | 6 | 6 | 6 | | | | | | |
| " | (7.26) | | | | 6 | | | | | |
| " | (7.28) | | | | | 6 | 6 | 6 | | |
| " | (8.7) | | | | | | | | 6 | 6 |
| g of P per kg of fabric | | 57 | 52 | 52 | 57 | 57 | 52 | 52 | 57 | 52 |
| g of N per kg of fabric | | 30 | 25 | 44 | 30 | 30 | 25 | 44 | 30 | 25 |
| Liquor uptake in % | | 70 | 70 | 70 | 70 | 70 | 70 | 70 | 70 | 70 |
| Degree of fixing in % | | 70 | 69 | 70 | 68 | 70 | 70 | 70 | 70 | 71 |
| Flame resistance | | | | | | | | | | |
| After rinsing, burning time (seconds) | | 1 | 0 | 0 | 1 | 1 | 0 | 0 | 1 | 0 |
| Tear length (cm) | | 10.5 | 10 | 12 | 11 | 11.5 | 12 | 12.5 | 11 | 11 |
| After 40 washes, burning time (seconds) | | 3 | 1 | 1 | 4 | 3 | 1 | 1 | 4 | 1 |
| Tear length (cm) | | 10 | 10.5 | 8 | 11.5 | 10.5 | 11 | 12 | 11 | 11 |
| Flexural stiffness (mg.cm) | | 2,734 | 4,342 | 2,860 | 3,705 | 3,746 | 3,177 | 2.075 | 3,191 | 3,530 |
| Flexural stiffness without agent for imparting a soft handle | | 4,383 | 7,236 | 5,266 | 4,383 | 4,383 | 7,236 | 5,266 | 4,383 | 7,236 |
| Abrasion loss (3 minutes at 3,000 revolutions/minute) (effective % by weight) | | 10 | 16 | 20 | 6.4 | 6.6 | 11 | 14 | 8.4 | 16 |
| Abrasion loss without added softener | | 13 | 16 | 20 | 13 | 13 | 16 | 20 | 13 | 16 |
| Handle after rinsing | | 2½ | 2¾ | 2¼ | 2¾ | 2¾ | 2½ | 2½ | 2½ | 2¾ |
| Handle without added softener | | 4 | 4 | 3¾ | 4 | 4 | 4 | 3¾ | 4 | 4 |

| | | PES/CO 67/33 Treated with liquor | | | | | | | | |
|---|---|---|---|---|---|---|---|---|---|---|
| | | J | K | L | M | N | O | P | Q | Un-treated |
| Constituents in g/l of liquor | | | | | | | | | | |
| THPC (76%) | | 585 | | | 585 | | 585 | | 585 | |
| Product according to Instruction 1 (76%) | | | 535 | | | 535 | | 535 | | |
| Product according to Instruction 24 (80%) | | | | 660 | | | | | | |
| Di-trimethylolmelamine | | | 103 | 86 | | 103 | | 103 | | |
| Piperidine | | 42 | | | 42 | | 42 | | 42 | |
| Agent for imparting a soft handle, of the formula | | | | | | | | | | |
| " | (8.7) | 6 | | | | | | | | |
| " | (8.8) | | 6 | | | | | | | |
| " | (8.9) | | | 6 | 6 | | | | | |
| " | (8.10) | | | | | 6 | | | | |
| " | (8.11) | | | | | | 6 | | | |
| " | (8.12) | | | | | | | 67 | | |
| " | (8.13) | | | | | | | | 6 | |
| g of P per kg of fabric | | 52 | 57 | 52 | 52 | 57 | 52 | 57 | 52 | O |
| g of N per kg of fabric | | 44 | 30 | 25 | 44 | 30 | 44 | 30 | 44 | |
| Liquor uptake in % | | 70 | 70 | 70 | 70 | 70 | 70 | 70 | 70 | |
| Degree of fixing in % | | 71 | 68 | 72 | 75 | 71 | 70 | 74 | 68 | |
| Flame resistance | | | | | | | | | | |
| After rinsing, burning time (seconds) | | 0 | 1 | 0 | 0 | 3 | 0 | 3 | 0 | Burns |
| Tear length (cm) | | 12 | 12 | 9 | 12.5 | 10.5 | 10 | 11 | 12 | |
| After 40 washes, burning time (seconds) | | 1 | 3 | 1 | 1 | 3 | 0 | 3 | 1 | Burns |
| Tear length (cm) | | 12 | 10 | 12 | 11 | 14.5 | 10.5 | 10 | 12 | |
| Flexural stiffness (mg.cm) | | 2,499 | 3,367 | 4,014 | 3,031 | 3,746 | 2,810 | 3,377 | 2,576 | |
| Flexural stiffness without added softener | | 5,266 | 4,383 | 7,236 | 5,266 | 4,383 | 5,266 | 4,383 | 5,266 | 250 |
| Abrasion loss (3 minutes at 3,000 revolutions/minute) (effective % by weight) | | 17 | 7.6 | 15 | 20 | 7 | 13 | 8.3 | 13 | |
| Abrasion loss without added softener | | 20 | 13 | 16 | 20 | 13 | 20 | 13 | 20 | 2.3 |
| Handle after rinsing | | 2½ | 2¾ | 2¾ | 2¾ | 2¾ | 2¾ | 2¾ | 2½ | 0 |
| Handle without added softener | | 3¾ | 4 | 4 | 3¾ | 4 | 3¾ | 4 | 3¾ | 0 |

| | | PES/CO 50/50 Treated with liquor | | | | | | | | | | | | | |
|---|---|---|---|---|---|---|---|---|---|---|---|---|---|---|---|
| | | B | C | R | S | T | F | G | I | J | L | M | U | O | Un-treated |
| Constituents in g/l of liquor | | | | | | | | | | | | | | | |
| THPC (76%) | | | 585 | | | 585 | | 585 | | 585 | | 585 | 585 | 585 | |
| Product according to Instruction 1 (76%) | | | | | | | | | | | | | | | |
| Product according to Instruction 24 (80%) | | 660 | | 660 | 660 | | 660 | | 660 | | 660 | | | | |
| Di-trimethylolmelamine | | 86 | | 86 | 86 | | 86 | | 86 | | 86 | | | | |
| Piperidine | | | 42 | | | 42 | | 42 | | 42 | | 42 | 42 | 42 | |
| Agents for imparting a soft handle of the formula | (7.1) | 6 | 6 | | | | | | | | | | | | |
| " | (7.24) | | | 6 | | | | | | | | | | | |
| " | (7.26) | | | | 6 | 6 | | | | | | | | | |
| " | (7.28) | | | | | | 6 | 6 | | | | | | | |
| " | (8.7) | | | | | | | | 6 | 6 | | | | | |
| " | (8.9) | | | | | | | | | | 6 | 6 | | | |
| " | (8.10) | | | | | | | | | | | | 6 | | |
| " | (8.11) | | | | | | | | | | | | | 6 | |

Table 18-continued

| | | | | | | | | | | | | | | | |
|---|---|---|---|---|---|---|---|---|---|---|---|---|---|---|---|
| | | | | | | | | | PES/CO 67/33 Treated with liquor | | | | | | |
| | | | | | | A | B | C | D | E | F | G | H | I | |
| g of P per kg of fabric | 52 | | 52 | 52 | 52 | 52 | 52 | 52 | 52 | 52 | 52 | 52 | 52 | 0 | |
| g of N per kg of fabric | 25 | | 44 | 25 | 25 | 44 | 25 | 44 | 25 | 44 | 25 | 44 | 44 | 44 | |
| Liquor uptake in % | 70 | | 70 | 70 | 70 | 70 | 70 | 70 | 70 | 70 | 70 | 70 | 70 | 70 | |
| Degree of fixing in % | 69 | | 69 | 70 | 67 | 66 | 69 | 66 | 70 | 73 | 70 | 67 | 67 | 69 | |
| Flame resistance | | | | | | | | | | | | | | | |
| After rinsing | | | | | | | | | | | | | | | |
| Burning time (seconds) | 0 | | 0 | 0 | 0 | 0 | 0 | 0 | 0 | 0 | 0 | 0 | 0 | 0 | Burns |
| Tear length (cm) | 10 | | 13 | 10 | 8.5 | 10.5 | 10 | 11.5 | 10 | 9 | 10 | 10 | 11.5 | 11 | |
| After 40 washes | | | | | | | | | | | | | | | |
| Burning time (seconds) | 1 | | 1 | 0 | 0 | 0 | 0 | 0 | 0 | 0 | 0 | 0 | 0 | 0 | Burns |
| Tear length (cm) | 10 | | 10 | 9 | 9.5 | 10 | 9.5 | 9.5 | 8.5 | 9.5 | 9.5 | 10 | 11 | 10 | |
| Flexural stiffness (mg. cm) | 4,967 | 2,614 | 3,958 | 3,659 | 2,583 | 2,342 | 2,110 | 2,368 | 2,334 | 3,703 | 1,978 | 2,532 | 2,607 | | |
| Flexural stiffness without added softener | 8,371 | 5,676 | 8,371 | 8,371 | 5,676 | 8,371 | 5,676 | 8,371 | 5,676 | 8,371 | 5,676 | 5,676 | 5,676 | 329 | |
| Abrasion loss (3 minutes at 3,000 revolutions/ minute) (effective % by weight) | 17 | 22 | 12 | 10 | 11 | 11 | 11 | 14 | 17 | 17 | 16 | 12 | 11 | | |
| Abrasion loss without added softener | 20 | 26 | 20 | 20 | 26 | 20 | 26 | 20 | 26 | 20 | 26 | 26 | 26 | 2 | |
| Handle after rinsing | 2¾ | 2¼ | 2¾ | 2¾ | 2¾ | 2½ | 2½ | 2¾ | 2½ | 2¾ | 2½ | 2¾ | 2½ | 0 | |
| Handle without added softener | 4 | 4 | 4 | 4 | 4 | 4 | 4 | 4 | 4 | 4 | 4 | 4 | 4 | 0 | |

EXAMPLE 12

Cotton fabrics are padded with the liquors from Table 19 which follows and are subsequently fixed as indicated in Example 1, rinsed, washed up to 40 times and tested for the flame resistance and their handle. In addition, the flexural stiffness and the abrasion resistance are investigated as indicated in Example 10 and the tear propagation resistance in the warp and weft direction is investigated according to SNV 198,482.

The results are summarised in Table 19.

Table 19

| | | Treated with liquor A | B | C | D | Untreated |
|---|---|---|---|---|---|---|
| Constituents in g/l of liquor | | | | | | |
| Product according to Instruction 1 (75% strength) | | 300 | 300 | 300 | 300 | |
| Di-trimethylolmelamine | | 120 | 120 | 120 | 120 | |
| Agent for imparting a soft handle, of the formula | | | | | | |
| " | (7.1) | | 6 | | | |
| " | (7.19) | | | 6 | | |
| "(8.7) | | | | 6 | | |
| pH value of the bath | | 5.9 | 5.9 | 5.9 | 5.9 | |
| g of P/kg of fabric | | 35 | 35 | 35 | 35 | 0 |
| g of N/kg of fabric | | 40 | 40 | 40 | 40 | |
| Liquor uptake in % | | 80 | 80 | 80 | 80 | |
| Degree of fixing in % | | 73 | 70 | 76 | 79 | |
| Flame resistance | | | | | | |
| After rinsing | | | | | | |
| Burning time (seconds) | | 0 | 0 | 0 | 0 | Burns |
| Tear length (cm) | | 7 | 6.5 | 7 | 7 | |
| After 40 washes | | | | | | |
| Burning time (seconds) | | 0 | 0 | 0 | 0 | Burns |
| Tear length (cm) | | 8.5 | 8.5 | 8.5 | 9 | |
| Flexural stiffness (mg.cm) | | 547 | 422 | 365 | 279 | 787 |
| Abrasion loss (3 minutes at 3,000 revolutions/ minute) (effective % by weight) | | 35 | 30 | 33 | 24 | 3.2 |
| Handle after rinsing | | 2 | 0 | 1 | 0 | 0 |
| Tear propagation resistance | | | | | | |
| Warp (Kp) | | 1.06 | 1.56 | 1.47 | 1.30 | 1.31 |
| Weft (Kp) | | 0.64 | 0.88 | 0.83 | 0.82 | 1.81 |

EXAMPLE 13

Mixed fabrics of polyester-cellulose (67:33) are padded with the liquors from Table 20 which follows and are subsequently fixed as indicated in Example 1, rinsed and washed up to 40 times, and their flame resistance and their handle is tested.

The results are summarised in Table 20.

Table 20

| | Treated with liquor A | B | Untreated |
|---|---|---|---|
| Constituents in g/l of liquor | | | |
| Products according to Instruction 1 (75% strength) | 560 | 560 | |
| Trimethylolmelamine monodimethyl ether* (80%) | 168 | | |
| Dimethylolacetoguanamine (100% strength) | | 113 | |
| Agent for imparting a soft handle, of the formula 7.1 (17% strength) | 35 | 35 | |
| pH value of the bath | 6 | 6 | |
| g of P per kg of fabric | 57 | 57 | 0 |
| g of N per kg of fabric | 30 | 30 | |
| Liquor uptake in % | 72 | 72 | |
| Degree of fixing in % | 67 | 62 | |
| Flame resistance | | | |
| After rinsing | | | |
| Burning time (seconds) | 2 | 2 | Burns |
| Tear length (cm) | 10.5 | 10 | |
| After 40 washes | | | |
| Burning time (seconds) | 11 | 10 | Burns |
| Tear length (cm) | 11 | 14.5 | |
| Handle after rinsing | 2¼ | 2½ | 0 |

*Fromm 1 mol of memamine, 3.7 mols of $CH_2O$ and 1.5 mols of $—OCH_3$.

We claim:

1. Composition for flameproofing organic fiber materials of cellulose/polyester, which essentially comprises 1. from 200 to 750 g/l of a tetrakis-(hydroxymethyl)-phosphonium compound, its self-condensation product or its condensation product with a reactive nitrogen compound,
2. from 3 to 20 g/l of an agent for imparting a soft handle, of the formula

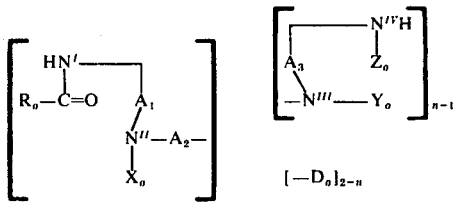

wherein $X_o$ and $Y_o$ each are hydrogen, alkyl with 1 to 4 carbon atoms or $—CONH_2$, $Z_o$ is hydrogen, alkyl with 1 to 4 carbon atoms, $—CONH_2$, $—C^{II}OR'_o$ or $—A_4—NH-CO—R''_o$, $A_1$, $A_2$, $A_3$ and $A_4$ each are alkylene with 2 or 3 carbon atoms, $D_o$ is hydrogen, —OH, $—NH_2$, $—NH—CO—NH_2$, $—CONH_2$, $—CO—NH—CO—NH_2$, $—(OCH_2—)_{m-1}—CO—NH—R'''_o$ or $—(OCH_2—)_{m-1}—NH—CO—R'''_o$, $R_o$, $R'_o$, $R''_o$ and $R'''_o$ each are alkenyl or alkyl with 9 to 23 carbon atoms, and m and n each are 1 or 2 and $X_o$ can also be a covalent bond to $C^I$ when H on $N^I$ and O on $C^I$ are omitted and there is a double bond between $N^I$ and $C^I$, and $Y_o$ can also be a covalent bond to $C^{II}$ when $Z_o$ is $—C^{II}OR'_o$, H on $N^{IV}$ and O on $C^{II}$ are omitted and there is a double bond between $N^{IV}$ and $C^{II}$, these softeners being present as tertiary amines or being quaternised by alkyl halides or dialkyl sulphates which possess 1 or 2 carbon atoms per alkyl radical or halogeno-carboxylic acid alkyl esters which contain up to 4 carbon atoms in the acid part and up to 22 carbon atoms in the alcohol part or up to 60 carbon atoms if the alkyl chains are interrupted by oxygen atoms, or being in the form of acid salts of alkylcarboxylic acids with at most 4 carbon atoms, and 3. from 20 to 200 g/l of a water-soluble 1,3,5-triazine which possesses 2 to 4 methylolated amino groups.

2. Composition according to claim 1, which comprises in addition to components (1), (2) and (3) (4) a compound of the formula

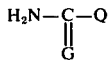

wherein G denotes oxygen or NH and Q denotes $—NH_2$, —NH—C=N or $—NHCONH_2$, or wherein G and Q together represent N or the corresponding methylolted or methylolated and with an alkanol with 1 to 4 carbon atoms etherified compound of the above formula.

3. Composition according to claim 1, which essentially comprises in addition to components (1), (2) and (3) from 0 to 100 g/l of a component (5) which is a low molecular aliphatic or heterocyclic amine.

4. Composition according to claim 3, which essentially comprises in addition to components (1) (2), (3) and (4), from 0 to 100 g/l of a component (5) which is a low molecular aliphatic or heterocyclic amine.

5. Composition according to claim 1, which essentially comprises, 1. a tetrakis-(hydroxymethyl)-phosphonium compound, its self-condensation product or its condensation product with a reactive nitrogen compound,
2. an agent for imparting a soft handle, of the formula

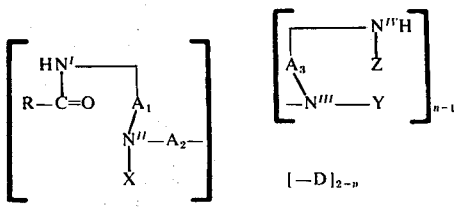

wherein X and Y each are hydrogen or $—CONH_2$, Z is hydrogen, alkyl with 1 to 4 carbon atoms, $—CONH_2$, $—C^{II}OR'$ or $—A_4—NHCO—R''$, $A_1$, $A_2$, $A_3$ and $A_4$ each are alkylene with 2 or 3 carbon atoms, D is hydrogen, —OH, $—NH_2$, $—CONH_2$ or $—(OCH_2—)_{m-1}—NH-CO—R'''$, R, R', R'' and R''' each are alkyl with 9 to 23 carbon atoms and m and n each are 1 or 2, and X can also be a covalent bond to $C^I$ when H on $N^I$ and O on $C^I$ are omitted and there is a double bond between $N^I$ and $C^1$, and Y can also be a covalent bond to $C^{II}$ when Z is $—C^{II}OR'$ H on $N^{IV}$ and O on $C^{II}$ are omitted and there is a double bond between $N^{IV}$ and $C^{II}$, these softeners being present as tertiary amines or being quaternised with alkyl halides or dialkyl sulphates which contain 1 or 2 carbon atoms per alkyl radical or with halogenocarboxylic acid alkyl esters which contain up to 4 carbon atoms in the acid part and up to 22 carbon atoms in the alcohol part and up to 60 carbon atoms if the alkyl chains are interrupted by oxygen atoms, or being in the form of acid salts of alkylcarboxylic acids with at most 4 carbon atoms, 3. a water-soluble 1,3,5-triazine which possesses 2 to 4 methylolated amino groups, and
4. compound of the formula

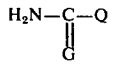

wherein G is oxygen or NH and Q is $—NH_2$, —N—H—C=N or $—NHCONH_2$, or wherein G and Q together represent ≡N or the corresponding methylolated and with an alkanol with 1 to 4 carbon atoms esterified compound of the above formula.

6. Composition according to claim 5, which essentially comprises in addition to components (1), (2), (3) and (4) a cmponent (5) which is a low molecular aliphatic or heterocyclic amine.

7. Composition according to claim 1, which essentially comprises as component (1) compound derived from a tetrakis-(hydroxymethyl)-phosphonium salt or hydroxide.

8. Composition according to claim 7, which essentially comprises as component (1) a compound derived from tetrakis-(hydroxymethyl)phosphonium chloride.

9. Composition according to claim 1, which essentially comprises a tetrakis-(hydroxymethyl)-phosphonium compound as such as the component (1).

10. Composition according to claim 1, which essentially comprises a self-condensation product of a tetrakis-(hydroxymethyl)-phosphonium compound as the component (1), which is obtained by condensing an anhydrous tetrakis-(hydroxymethyl)-phosphonium salt or -hydroxide, with itself in an anhydrous medium, at 100° to 150°C, the condensation being continued until 0.5 to 1.5 mols of water have been separated off per 1 mol of phosphonium compound employed, free hydroxyl groups being not etherified or being etherified, at least partially, with at least one alkanol with 1 to 4 carbon atoms.

11. Composition according to claim 10, which essentially comprises a self-condensation product of a tetrakis-(hydroxymethyl)-phosphonium compound as the component (1) which is obtained by condensing an anhydrous tetrakis-(hydroxymethyl)-phosphonium salt or -hydroxide with itself in the presence of at least one aliphatic halogenated hydrocarbon as inert organic solvent at 125° to 145°C, the condensation being continued until 0.7 to 1.2 mol of water have been separated off per 1 mol of phosphonium compound employed.

12. Composition according to claim 1, which essentially comprises as component (I) a condensation product of a tetrakis-(hydroxymethyl)-phosphonium compound with a polyfunctional reactive nitrogen compound from the series of cyanamide, dicyandiamide, urea, thiourea, biuret, guanidine, guanidine salt, guanylurea, guanylurea salt, monocyclic or bicyclic urea, carboxylic acid amide, carboxylic acid carbamate or amino-1,3,5-triazine, or with a nitrogen compound from the series of amines, penta-aza-bicyclo-nonadienes or their salts or triglycidylisocyanurate, or with the corresponding methylolated or methylolated and with an alkanol with 1 to 5 carbon atoms, etherified water-soluble nitrogen compound.

13. Composition according to claim 12 which essentially comprises as component (1) a condensation product of 1 mol of tetrakis-(hydroxymethyl)-phosphonium chloride and 0.02 to 1 mol of dimethylolurea.

14. Composition according to claim 1, which essentially comprises as component (2) a heterocylic nitrogen compound or a mono- or di-imidazoline of the formula

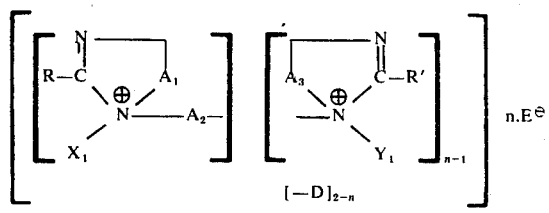

wherein $A_1$, $A_2$ and $A_3$ each are alkylene with 2 or 3 carbon atoms, D is hydrogen, —OH, $—NH_2$, $—CONH_2$ or $—(OCH_2—)_{m-1}—NHCO—R'''$, R, R', R'' and R''' each are alkyl with 9 to 23 carbon atoms, m and n each are 1 or 2, $X_1$ and $Y_1$ each are hydrogen, alkyl with 1 or 2 carbon atoms or alkoxycarbonylalkyl with 1 to 4 carbon atoms in the alkyl part and 1 to 22 carbon atoms in the alkoxy part, it being possible for the latter to be interrupted by oxygen atoms in the carbon chain, and $E^-$ is a monovalent amion of a hydrogen halide acid, of a dialkyl sulphate with 1 to 2 carbon atoms in the alkyl radical, or of an alkylcarboxylic acid with 1 to 4 carbon atoms.

15. Composition according to claim 1, which essentially comprises as component (2) an amide of the formula

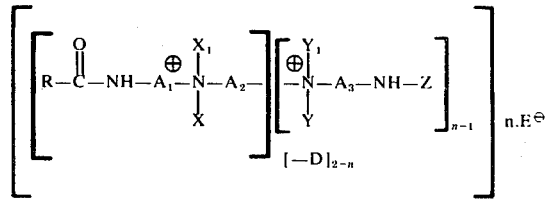

wherein X and Y each is hydrogen or $—CONH_2$, Z is hydrogen, alkyl with 1 to 4 carbon atoms, $—CONH_2$, $—C^{II}OR'$ or $—A_4—NHCO—R''$, $A_1$, $A_2$, $A_3$ and $A_4$ each are alkylene with 2 or 3 carbon atoms, D is hydrogen, —OH, $—NH_2$, $—CONH_2$ or $—(OCH_2—)_{m-1}—NHCO—R'''$, R, R', R'' and R''' each are alkyl with 9 to 23 carbon atoms and m and n each are 1 or 2, $X_1$ and $Y_1$ each denote hydrogen, alkyl with 1 or 2 carbon atoms or alkoxycarbonylalkyl with 1 to 4 carbon atoms in the alkyl part and 1 to 22 carbon atoms in the alkoxy part, it being possible for the latter to be interrupted by oxygen atoms in the carbon chain, and $E^-$ is a monovalent anion of a hydrogen halide acid, of a dialkyl sulphate with 1 or 2 carbon atoms in the alkyl radical, or of an alkylcarboxylic acid with 1 to 4 carbon atoms.

16. Composition according to claim 1, which essentially comprises as component (2) an imidazoline of the formula

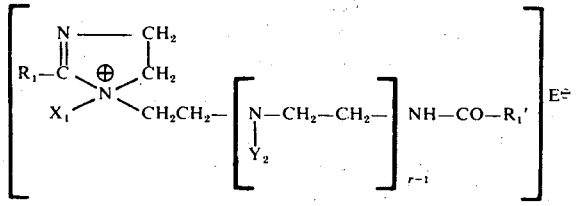

wherein $R_1$ and $R_1'$ each are alkyl with 15 to 21 carbon atoms, $Y_2$ is hydrogen or $—CONH_2$ and r is 1 or 2 and $X_1$ and $Y_1$ each are hydrogen, alkyl with 1 or 2 carbon atoms or alkoxycarbonylalkyl with 1 to 4 carbon atoms in the alkyl part and 1 to 22 carbon atoms in the alkoxy part, it being possible for the latter to be interrupted by oxygen atoms in the carbon chain, and $E^-$ is a monovalent anion of a hydrogen halide acid, of a dialkyl sulphate with 1 or 2 carbon atoms in the alkyl radical, or of an alkylcarboxylic acid with 1 to 4 carbon atoms.

17. Composition according to claim 16, which essentially comprises as component (2) an imidazoline of the formula

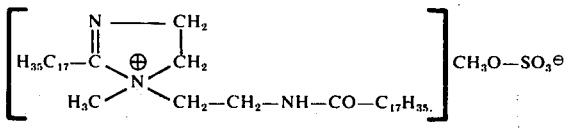

18. Composition according to claim 14, which essentially comprises as component (2) a-di-imidazoline of the formula

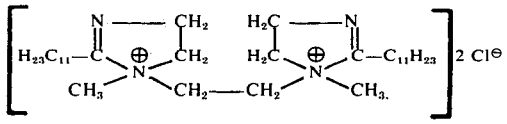

19. Composition according to claim 15, which essentially comprises as component (2) the amide of the formula

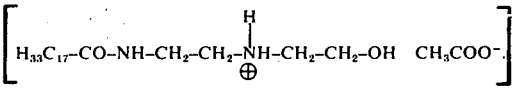

20. Composition according to claim 1, which essentially comprises as component (3) dimethylolmelamine, trimethylolmelamine, trimethylolmelamine monomethyl ether or trimethylolmelamine dimethyl ether or mixtures of individual members of these melamines.

21. Composition according to claim 2, which essentially comprises biuret, urea or a methylolurea as component (4).

22. Composition according to claim 3, which essentially comprises a secondary or tertiary aliphatic amine as component (5).

23. Composition according to claim 3, which essentially comprises piperidine as component (5).

24. Process for flameproofing organic fiber materials of cellulose/polyester which essentially comprises treating the material with a composition according to claim 1 and subjecting the material treated to a fixing process.

25. The organic fiber materials of cellulose/polyester provided with a flame-proof finish according to the process of claim 24.

* * * * *

UNITED STATES PATENT AND TRADEMARK OFFICE

CERTIFICATE OF CORRECTION

PATENT NO. : 3,956,243

DATED : May 11, 1976

INVENTOR(S) : RUDOLF LOSS ET AL

It is certified that error appears in the above-identified patent and that said Letters Patent are hereby corrected as shown below:

Column 48, claim 2,
line 6, insert --- essentially --- after "which".
line 8, insert --- from 0 to 120 g/l of --- after "(4)".
line 36, delete "denotes" in both occurrences and insert --- is ---.
line 38, delete delete "N" and insert --- $\equiv$N ---.
line 39, delete "methylolted" and insert --- methylolated ---.

Column 48, claim 3, line 42, delete "1" and insert --- 2 ---.

Column 48, claim 4, line 47, between "(1)" and "(2)" insert --- , ---.

Column 49, claim 5, line 8, between "—$C^{II}OR'$" and "H" insert --- , ---.

Column 49, claim 6, line 34, delete "cmponent" and insert --- component ---.

Column 49, claim 7, line 37, between "(1)" and "compound" insert --- a ---.

Column 52, claim 19, delete the structural formula as it now reads and insert

---

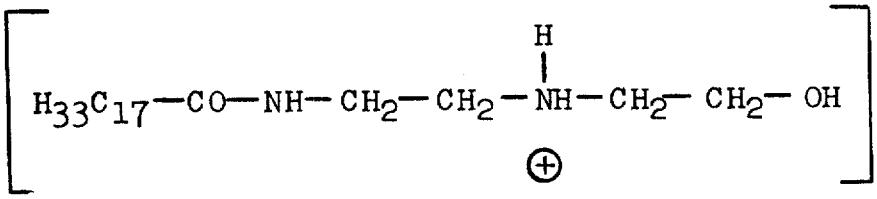

--

Signed and Sealed this

Twenty-third Day of November 1976

[SEAL]

*Attest:*

RUTH C. MASON
*Attesting Officer*

C. MARSHALL DANN
*Commissioner of Patents and Trademarks*